US006539869B2

(12) United States Patent
Knowlton et al.

(10) Patent No.: US 6,539,869 B2
(45) Date of Patent: Apr. 1, 2003

(54) HEAT TRANSFER INITIATOR

(75) Inventors: Gregory D. Knowlton, Higley, AZ (US); Christian Salafia, Mesa, AZ (US); Bruce B. Anderson, Mountain View, CA (US); Theodore B. Gortemoller, Shalimar, FL (US)

(73) Assignee: Talley Defense Systems, Inc., Mesa, AZ (US)

( * ) Notice: Subject to any disclaimer, the term of this patent is extended or adjusted under 35 U.S.C. 154(b) by 56 days.

(21) Appl. No.: 09/933,441

(22) Filed: Aug. 20, 2001

(65) Prior Publication Data

US 2002/0035945 A1 Mar. 28, 2002

Related U.S. Application Data

(63) Continuation-in-part of application No. 09/428,329, filed on Oct. 27, 1999, now Pat. No. 6,298,784.

(51) Int. Cl.[7] ..... C06C 5/04; C06C 9/00
(52) U.S. Cl. ..... 102/275.3; 102/205
(58) Field of Search ..... 102/205, 275.3

(56) References Cited

U.S. PATENT DOCUMENTS

| | | | | | |
|---|---|---|---|---|---|
| 2,429,290 | A | | 10/1947 | Scherrer | 102/28 |
| 2,506,157 | A | | 5/1950 | Loret | 102/28 |
| 3,727,552 | A | | 4/1973 | Zakheim | 102/27 R |
| 3,945,322 | A | | 3/1976 | Carlson et al. | 102/70 R |
| 3,999,484 | A | | 12/1976 | Evans | 102/28 R |
| 4,358,998 | A | | 11/1982 | Schneiter et al. | 102/530 |
| 4,503,773 | A | | 3/1985 | Bolieau | 102/202 |
| 4,539,910 | A | | 9/1985 | Stevens | 202/349 |
| 4,574,699 | A | * | 3/1986 | Bolieau | 102/202 |
| 4,592,281 | A | | 6/1986 | Nagennast | 102/254 |
| 4,608,926 | A | | 9/1986 | Stevens | 102/275.4 |
| 4,699,400 | A | | 10/1987 | Adams et al. | 280/731 |
| 4,759,291 | A | | 7/1988 | Barker et al. | 102/202.5 |
| 4,766,726 | A | | 8/1988 | Tackett et al. | 60/255 |
| 4,829,765 | A | | 5/1989 | Bolieau et al. | 60/250 |
| 4,901,642 | A | * | 2/1990 | White et al. | 102/202 |
| 5,150,654 | A | * | 9/1992 | Grosgebauer et al. | 102/202 |
| 5,220,783 | A | * | 6/1993 | Cherry et al. | 60/204 |
| 5,593,181 | A | | 1/1997 | Walker et al. | 280/741 |
| 5,739,460 | A | | 4/1998 | Knowlton et al. | 102/324 |
| 5,763,818 | A | * | 6/1998 | Guymon et al. | 102/336 |
| 5,842,716 | A | | 12/1998 | Breed | 280/734 |
| 5,959,236 | A | | 9/1999 | Smith et al. | 102/204 |
| 5,959,242 | A | | 9/1999 | Knowlton et al. | 149/38 |
| 6,101,947 | A | | 8/2000 | Knowlton et al. | 102/288 |
| 6,168,202 | B1 | | 1/2001 | Stevens | 280/737 |

OTHER PUBLICATIONS

U.S. Application No. 09/428,329 (now U.S.P. 6,298,784)—Parent Application.

* cited by examiner

*Primary Examiner*—Charles T. Jordan
*Assistant Examiner*—Aileen J. Baker
(74) *Attorney, Agent, or Firm*—Fitzpatrick, Cella, Harper & Scinto LLP

(57) ABSTRACT

A non-detonating heat transfer initiator. A representative heat transfer initiator is in the form of a heat transfer control medium, having a heat input portion and a heat output portion, and a non-detonating autoignition material, having an autoignition temperature, in thermal contact with the heat output portion. When heat is applied to the heat input portion, a transfer of heat through the heat transfer control medium to the heat output portion results, heating the heat output portion, such that, upon application of a sufficient amount of heat to the heat input portion, the heat output portion is heated to the autoignition temperature of the non-detonating autoignition material, igniting the non-detonating autoignition material ignites, thus producing a non-detonating thermal output.

36 Claims, 11 Drawing Sheets

HEAT TRANSFER INITIATOR

CROSS REFERENCE TO RELATED APPLICATIONS

This application is a continuation-in-part of U.S. application Ser. No. 09/428,329, filed Oct. 27, 1999, now U.S. Pat. No. 6,298,784, the teaching of which is incorporated herein in its entirety by reference.

FIELD OF THE INVENTION

The present invention is directed to heat transfer initiators for propellant, pyrotechnic, and explosive devices. In particular, the present invention is directed to initiators that utilize heat transfer to ignite an non-detonating autoignition material to act as a thermal switch to reliably and precisely control the time to function of propellant, pyrotechnic, and explosive devices, and may also be used to reliably and precisely control the time to function of such devices. The initiators of the present invention are particularly useful as through-bulkhead initiators.

BACKGROUND OF THE INVENTION

Various initiators that are actuated by a pyrotechnic, electronic, or mechanical input are known in the art for the control of the function of propellant, pyrotechnic, and explosive devices. Initiators are used in a variety of applications, including, but not limited to, passive vehicular safety systems, fire suppression systems, rockets, and munitions. When actuated, the initiator provides a thermal output, typically, in the form of heat, hot gas, hot particulates, and/or flame. Actuation of a prior art initiator is typically achieved electrically, or mechanically.

In many applications, where a reliable electrical actuation signal is available, such as in vehicular air bag systems, a pyrotechnic squib may be used as an initiator. Pyrotechnic squibs such as those disclosed in U.S. Pat. No. 6,168,202 to Stevens, are well known in the art. A typical pyrotechnic squib includes a pair of electrical leads, connected by a bridge wire, which is in thermal contact with an ignition composition. Passing an electrical signal through the electrical leads and the bridge wire, heats the bridge wire, and ignites the ignition composition. The thermal output from the reaction or combustion of the ignition compound ignites a pyrotechnic material within the squib that provides the desired thermal output used to initiate function of a main propellant, pyrotechnic, or explosive charge. Pyrotechnic squibs will only function properly in applications where an electrical actuation signal is reliably available.

A mechanically actuated initiator is disclosed in U.S. Pat. No. 5,913,807 to Bak. The disclosed initiator uses a percussion primer, of the type used in bullets, which, when struck ignites a second charge that provides the desired thermal output. However, such mechanical actuation systems can be complicated and unreliable.

U.S. Pat. No. 3,945,322 to Carlson et al. discloses a through-bulkhead initiator for causing an explosion on one side of a bulkhead by initiating an explosion on the other side of the bulkhead, and transmitting the shock wave from the first explosion through the bulkhead. However, the use of an explosion and the resulting shockwave may be undesirable in many applications where the explosion and shockwave can damage equipment, or where an output of heat and/or flame is required.

Similarly, U.S. Pat. No. 4,503,773 discloses a through bulkhead initiator for use with a rocket motor. The initiator consists of a thin metal bulkhead with a small explosive charge on either side of the bulkhead. The first explosive charge is detonated by a confined detonating fuse, producing a shock wave that passed through the bulkhead without breaking the bulkhead. The shock wave then detonates the second explosive charge on the other side of the bulkhead, initiating combustion of a flame output charge.

Pyrotechnic, electronic, and mechanical initiators that control the time to function of propellant, pyrotechnic, and explosive devices are known as delays, and are frequently used to control functions of munitions, such as self-destruct and self-disable, and the propellant ignition time of a rocket or rocket assisted projectile, where the timing of the ignition of the propellant is critical in achieving maximum range. Pyrotechnic initiators that provide a delay time generally rely on the controlled burning of a pyrotechnic material, acting essentially as a fuse, such that the length of the column of pyrotechnic material and the burning rate of the material determine the time of the delay. That is, the delay time is the time between the ignition of the pyrotechnic column and the ignition of the propellant, pyrotechnic, and explosive device by the heat and/or flame output generated by the combustion of the pyrotechnic column. For example, in a projectile having a range extending propellant, the initial end of a pyrotechnic delay column/ignition train is ignited as the shell is fired. The range extending propellant grain is then ignited by the heat and/or flame output of the pyrotechnic delay column/ignition train when the burning portion of the delay column/ignition train reaches the propellant. The delay time is then the time between the ignition of the pyrotechnic delay column/ignition train and the ignition of the range extending propellant grain by the output of the pyrotechnic delay column/ignition train.

Such pyrotechnic initiators that provide delays typically require a rapid burn rate for reliability. Slower burning pyrotechnics are harder to ignite than fast burning pyrotechnics, and, typically, do not burn at a constant rate. Therefore, the delay time of slow burning pyrotechnics is less reliable than faster burning pyrotechnic delays, and reliable longer delay times are not easily obtained.

Control of the delay time of reliable, fast burning pyrotechnic delays is achieved by determining the burn rate of the pyrotechnic material and the length of pyrotechnic material that is needed to burn for the required time. As a result, the use of pyrotechnic delays in timing munition events is primarily limited by the space requirements of the munition, i.e., by the length of the column that will fit in the munition. Therefore, extended delay times are difficult to achieve because of the excessive length of pyrotechnic material required and/or the need for a slow burning pyrotechnic material. Typical size limitations for pyrotechnic delays using burn rate and column length to control the delay are driven by a nominal lower burn rate of about 0.1 inch (2.5 mm) per second for pyrotechnic columns having a cross section of about ⅛ inch (3 mm) for columns up to about ⅜ inch (9.1 mm), with cross-sections of about ¼ inch (6.4 mm) for longer columns. The burn rate, heat loss, and column cross section are all closely interrelated, and, thus, the column must be carefully tailored to obtain reliable performance at or near the limits described above.

Electronic delays are typically used in situations where pyrotechnic delays are inadequate. The requirements for the self-destruction of munitions dictates long delay times, i.e., in excess of 30 seconds. For long delay times, electronic delay mechanisms are typically utilized because pyrotechnics cannot provide the delay time required within the packaging constraints. For time delays greater than 30 seconds, electronic delays offer greater packaging efficiency than pyrotechnic delays, but at a significant cost premium. In addition, electronic delays are much less durable than pyrotechnic delays, being comparatively fragile and, thus, susceptible to damage by the high acceleration or "g" loading experienced when the projectile is fired or the munition is launched or ejected.

Mechanical delays are less common for timing munitions because of their poor reliability. In particular, pre-wound spring mechanisms fatigue over time, and complex winding or other energizing mechanisms are inherently less reliable.

Although unique pyrotechnic initiators that utilize heat transfer through various media to provide a thermal output with a short delay time, i.e., less than about 0.5 seconds, are known in the art, there is no known disclosure of pyrotechnic initiators having a non-detonating thermal output that are capable of providing a reliable delay time of greater than 0.5 seconds. For example, U.S. Pat. No. 2,506,157 to Loret discloses a delay action blasting cap that allows a series of blasting caps to be produced having delays that differ one from another by small fractions of a second. The delay action blasting cap comprises an ignition charge in intimate contact with one end of a piece of heat conducting incombustible material, having an explosive fulminating element, i.e., a primary explosive that detonates upon ignition, at the end opposite the ignition charge. Upon combustion of the ignition charge, heat is transferred to, and travels through the piece of heat conducting material. The transfer of heat through the heat conducting material to the fulminating element causes the fulminating element to detonate, resulting in the detonation of the output charge. The amount of time required for the heat to travel from the ignition charge, through the heat conducting material to the fulminating element, causing the fulminating element to detonate, is the delay time of the blasting cap. However, the detonating output of such a delay is not as practical for initiating a propellant or pyrotechnic device that requires a heat and/or flame output.

U.S. Pat. No. 2,429,490 to Scherrer discloses detonators having delay times of from about 5 to about 30 milliseconds (ms). The delay is obtained by placing a thin metal disk, e.g., about 0.0015 inch thick, between a heating charge and a detonating charge. Heat generated by the combustion of the heating charge is rapidly transmitted through the disk to initiate the detonating charge after a short delay.

U.S. Pat. No. 3,727,552 to Zakheim discloses a bidirectional delay connector comprising a shell containing a separate detonating charge adjacent to each end of the connector, where the ends are adapted to receive a detonating fuse. Each detonating charge is also in close proximity to an exothermic charge at an end of a centrally located metal relay capsule, where a heat-conductive metallic delay element is positioned between each heat sensitive charge and the relay capsule containing the exothermic charges. Delay times on the order of 200 ms are produced.

U.S. Pat. No. 3,999,484 to Evans discloses a delay device having a dimpled transfer disc positioned between a delay charge and an output explosive charge. The delay time of 20 ms to 20 s is provided by the burning time of the delay charge. The disc, which is typically only about 0.01 inch thick, contributes little to the overall delay time.

U.S. Pat. Nos. 4,358,998 and 5,593,181 to Schneider et al. and Walker et al., respectively, disclose igniters for pyrotechnic gas bag inflators for vehicles, where short delays on the order of a few milliseconds are required.

A need exists for a small, reliable, low cost initiator or delay mechanism having a non-detonating thermal output. The present invention provides such a initiator.

SUMMARY OF THE INVENTION

The present invention is directed to a non-detonating heat transfer initiator and to a method of producing a non-detonating output with the initiator of the invention. The non-detonating heat transfer initiator of the invention comprises a heat transfer control medium, having a heat input portion and a heat output portion, and a non-detonating autoignition material, having an autoignition temperature, in thermal contact with the heat output portion, where the heat transfer control medium may be in the form of a housing or a thermal choke. Application of heat to the heat input portion causes a transfer of heat through the heat transfer control medium to the heat output portion, heating the heat output portion, such that, upon application of a sufficient amount of heat to the heat input portion, the heat output portion is heated to the autoignition temperature of the non-detonating autoignition material, igniting the non-detonating autoignition material ignites, thus producing a non-detonating thermal output. The non-detonating heat transfer initiator of the invention may further comprise a pyrotechnic heat source in thermal contact with the heat input portion as the source of heat applied to the heat input portion.

To at least partially reduce heat loss from the heat transfer control medium, the non-detonating heat transfer initiator may further comprise an insulating material at least partially surrounding the heat transfer control medium. Useful insulating materials include ceramics, filled epoxy resins, glasses, composites, paints, laminates, non-heat-conductive polymers, expanded polytetrafluoroethylene, natural and synthetic rubbers, urethanes, and heat resistant composites. Preferably, the insulating material is glass tape, polyethylene, an epoxy, or expanded polytetrafluoroethylene.

The non-detonating heat transfer initiator of the invention may take various forms, such as, e.g., a bulkhead, having first and second opposed side surfaces, where the first side surface serves as the heat input portion, and the second side surface serves as the heat output portion. The heat output portion may comprise a heat output source cavity defined in the second opposed side of the bulkhead. Optionally, the non-detonating heat transfer initiator may further comprise a pyrotechnic heat source in thermal contact with the heat input portion. In such a device, the heat input portion may further comprise an input heat source cavity defined in the first side surface of the bulkhead into which the optional pyrotechnic heat source is placed.

In an alternate embodiment, the non-detonating heat transfer initiator is in the form of a rod or disk, having first and second opposed surfaces, where the first surface serves as the heat input portion, and the second surface serves as the heat output portion. The heat output portion may comprise any of an output heat source cavity defined in the second opposed surface of the rod or disk, a pyrotechnic heat source in thermal contact with the heat input portion, and an input heat source cavity defined in the first surface of the rod or disk. The heat transfer control medium may serve as a thermal choke having a cross sectional area and a thermal conductivity that control the transfer of heat from the heat input portion to the heat output portion.

The non-detonating heat transfer initiator may be used as a through-bulkhead-initiator ("TBI") by positioning the heat transfer control medium in an aperture defined by a bulkhead, having a first side and a second opposed side. Preferably, an insulating material partially surrounds the heat transfer control medium to at least partially reduce heat loss from the heat transfer control medium by forming at least a partial thermal barrier between the heat transfer control medium and the bulkhead. At least one of the heat input portion and the heat output portion may be substantially flush with the first side or the second opposed side of the bulkhead, or may extend outwardly from or may be depressed into the first side or the second opposed side of the bulkhead.

The invention also provides a method of producing a non-detonating thermal output. The method comprises applying heat to a heat transfer control medium in thermal contact with a non-detonating autoignition material, the non-detonating autoignition material having an autoignition temperature, conducting at least a portion of this heat through the heat transfer control medium to the non-detonating autoignition material, raising the temperature of the non-detonating autoignition material with the heat to at least the autoignition temperature, and, thus, igniting the non-detonating autoignition material, and producing a non-detonating thermal output due to the ignition. The method may further comprise insulating at least a portion of the heat transfer control medium to prevent heat loss. The method may further comprise placing a pyrotechnic heat source in thermal contact with the heat transfer control medium, igniting the pyrotechnic heat source, thereby producing heat from combustion or reaction of the pyrotechnic heat source, and transferring at least a portion of the heat from the combustion or reaction to the heat transfer control medium. Where a pyrotechnic heat source is not used, the source of heat may be the result of an increase in ambient temperature from, e.g., a fire or the like. As It will be recognized that The autoignition material useful in the heat transfer initiator and the method of the invention is preferably non-detonating, and may be nitrocellulose, nitroglycerine based smokeless gun powders, safety and strike anywhere match compositions, smoke compositions, friction primer compositions, plastic bonded starter compositions, white smoke compositions, sugar based compositions, diazidodinitrophenol (DDNP) compositions, mixtures of an oxidizer composition and a powdered metal fuel, and mixtures thereof. Preferably, the non-detonating autoignition material comprises a mixture of an oxidizer composition and a powdered metal fuel, where the oxidizer composition is selected from the group consisting of alkali metal nitrates, alkaline earth metal nitrates, complex salt nitrates, dried, hydrated nitrates, silver nitrate, alkali metal chlorates, alkali metal perchlorates, alkaline earth metal chlorates, alkaline earth metal perchlorates, ammonium perchlorate, sodium nitrite, ammonium nitrate, potassium nitrite, silver nitrite, complex salt nitrites, solid organic nitrates, solid organic nitrites, solid organic amines, and mixtures and comelts thereof. Most preferably, the oxidizer composition is selected from the group consisting of silver nitrate, and mixtures and comelts of at least one of silver nitrate or ammonium nitrate and at least one of alkali metal nitrates, alkaline earth metal nitrates, ammonium nitrate, complex salt nitrates, dried, hydrated nitrates, alkali metal chlorates, alkali metal perchlorates, alkaline earth metal chlorates, alkaline earth metal perchlorates, ammonium perchlorate, nitrites of sodium, nitrites of potassium, nitrites of silver, solid organic nitrates, solid organic nitrites, and solid organic amines. The powdered metal fuel is preferably selected from the group consisting of molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, silicon, and mixtures thereof, and is most preferably molybdenum.

Representatives of the non-detonating autoignition material include mixtures of potassium nitrate, silver nitrate, and molybdenum; guanidine nitrate, silver nitrate, and molybdenum; silver nitrate, potassium nitrate, guanidine nitrate, fumed silica, and molybdenum; lithium nitrate, guanidine nitrate, ammonium perchlorate, fumed silica, and molybdenum; ammonium nitrate, guanidine nitrate, and molybdenum; mixtures of ammonium nitrate, guanidine nitrate, nitroguanidine, and molybdenum; mixtures of ammonium nitrate, tetramethylammonium nitrate, and molybdenum; mixtures of ammonium nitrate, guanidine nitrate, tetramethylammonium nitrate, and molybdenum; mixtures of ammonium nitrate, 5-aminotetrazole, potassium chlorate, and molybdenum; mixtures of ammonium nitrate, 5-aminotetrazole, potassium perchlorate, and molybdenum; mixtures of ammonium nitrate, barbituric acid, potassium chlorate, and molybdenum; and mixtures of ammonium nitrate, barbituric acid, potassium perchlorate, and molybdenum.

The pyrotechnic heat source may be a thermite, thermate, delay composition, halogenated composition, torch/flare composition, igniter composition, intermetallic composition, or mixtures thereof.

Useful materials for the heat transfer control medium include any material that will conduct heat from the pyrotechnic heat source to the autoignition material, including, but not limited to metals, alloys, ceramics, aluminas, silicas, alumina silicates, alumina borates, alumina silica borates, alumina nitrides, beryllias, carbides, composites, fiberglass, and graphite.

Preferably, the heat transfer control medium serves as a thermal choke having a cross sectional area and a thermal conductivity that control the transfer of heat from the heat input portion to the heat output portion of the heat transfer control medium. In addition, to reduce or eliminate a loss of heat from the heat transfer control medium, an insulating material at least partially surrounding the heat transfer control medium may be used. Useful insulating materials include, but are not limited to, ceramics, filled epoxies, glasses, composites, paints, laminates, non-heat-conductive polymers, expanded polytetrafluoroethylene (PTFE), such as GORE-TEX® and TEFLON®, natural and synthetic rubbers, urethanes, and heat resistant composites, where glass tape, polyethylene, an epoxy resin, expanded TEFLON®, or PTFE are preferred.

The present invention may be used to provide a delay time in propellant, pyrotechnic, and explosive devices. Upon the application of heat to the heat input portion of the heat transfer control medium, such as, e.g., from the ignition and combustion or reaction of a pyrotechnic heat source or an increase in ambient temperature, the heat is transferred through the heat transfer control medium to the heat output portion of the heat transfer control medium. When a sufficient amount of heat is applied to the heat input portion, the heat output portion is heated to a temperature sufficiently high to ignite the non-detonating autoignition material, and produce a non-detonating thermal output therefrom, where the heat transfer control medium conducts heat at a rate. In this manner, a delay time of at least about 0.5 second can be obtained between the application of heat and the ignition of the non-detonating autoignition material. By varying at least one parameter, such as, e.g., the cross sectional area, length, and thermal conductivity of the heat transfer control medium, the amount of heat applied, which may be determined from the ambient temperature or the amount and heat of reaction of the pyrotechnic heat source, and/or the autoignition temperature of the non-detonating autoignition material, the delay time can be adjusted to a desired duration, such as, e.g., at least about 0.5, 1, 2, 5, 10, 15, 20, 30, 60, 90 seconds, or longer.

The invention also provides a method of delaying production of a non-detonating thermal output using the heat transfer initiator of the invention. The method comprises placing a heat transfer control medium, which may be insulated, in thermal contact with a heat source and a non-detonating autoignition material. The heat provided by the heat source is conducted through the heat transfer control medium to the non-detonating autoignition material, raising the temperature of the non-detonating autoignition material to at least the autoignition temperature of the material, and, thus, igniting the non-detonating autoignition material, and producing a non-detonating thermal output due to the ignition. Preferably, the heat transfer control medium conducts heat at a rate such that a delay time of at least about 0.5 seconds elapses between ignition of the heat source and ignition of the non-detonating autoignition material. At least one of the cross sectional area, length, and thermal conductivity of the heat transfer portion, the amount and heat of reaction of the pyrotechnic heat source, the autoignition temperature of the non-detonating autoignition material may be varied to adjust the delay time to a desired duration.

DETAILED DESCRIPTION OF THE INVENTION

Figure 1:
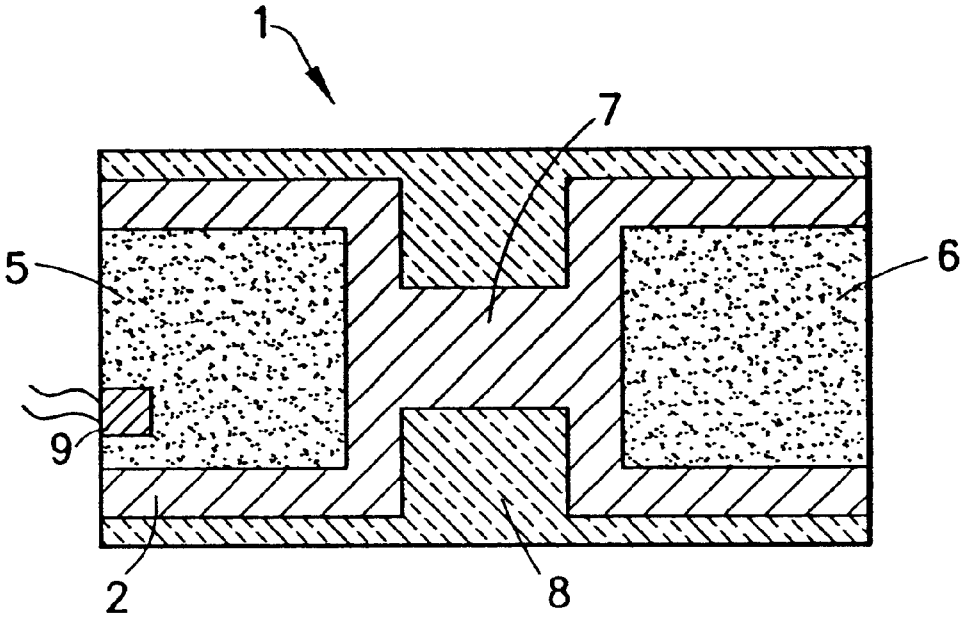
FIG. 1 is a cross sectional illustration of a heat transfer initiator of the invention.

As used herein, the terms "detonate" and "detonation" refer to the explosive combustion or decomposition of a primary explosive, such as lead azide or fulminate of mercury, where the combustion or decomposition reaction exceeds the speed of sound, creating a shock wave, and resulting in an explosion whether the explosive is confined or not.

Therefore, as used herein, the term "non-detonating" refers to the combustion, reaction, or decomposition of a pyrotechnic material, where the combustion, reaction, or decomposition reaction does not exceed the speed of sound, so that a shock wave is not produced, and an explosion does not occur. Instead, the non-detonating combustion or decomposition of a pyrotechnic material will produce at least one of heat (i.e., thermal energy), gas, or flame, and will only cause an explosion when confined, where an increase in pressure within the container that confines the material causes the container to explode.

Furthermore, as used herein, the terms "non-detonating output" and "non-detonating thermal output" refer to a non-explosive release of at least one of heat, gas, or flame from the combustion, reaction, or decomposition of a "non-detonating material", i.e., a material that does not detonate on combustion, reaction, or decomposition. However, a non-detonating output may be used to cause the detonation of a material that will detonate when exposed to heat or flame.

As used herein, the terms "delay device " and "delay mechanism" refer to initiators that provide a time delay before producing an output.

In addition, as used herein, the term "cavity" refers to any means for holding or positioning a pyrotechnic heat source or autoignition material within the heat transfer initiator of the invention, a "tube" is any hollow elongated structure, which may have any cross sectional shape, and a "rod" is any elongated structure that is substantially solid, having any cross sectional shape. Tubes and rods may be straight or curved along their length, and have cross sectional areas and shapes that vary along their length.

As used herein, the term "disk" refers to any structure having a thickness that is equal to or less the width of the structure. Disks may be straight or curved along the thickness, and have cross sectional areas and shapes that vary along the thickness.

Also as used herein, the term "bulkhead" includes any barrier, wall, bulkhead, firewall, and the like.

The present invention is directed to a heat transfer initiator ("HTI") that is suitable for use in various initiator and delay applications, typically for controlling the function of devices that utilize pyrotechnic, propellant, and explosive materials to function, such as, e.g., fire suppression systems, munitions, rocket propellants, and blasting devices. The heat transfer initiator of the invention may also be used as a heat transfer delay ("HTD") for controlling the delay time, e.g., the time to function, of such devices, as well as initiating the function of a device across a barrier, such as through bulkhead initiators. For use in fire suppression systems, the heat transfer initiator of the invention may be used as a primary or secondary initiator that activates the system when exposed to a sufficient amount of heat. In addition, the heat transfer initiator of the invention may be used in sequential pyrotechnic devices in which the heat of the output from a first device is used to activate the heat transfer initiator, thereby initiating the function of a second pyrotechnic device. In such sequential systems, the invention is often utilized as a through-bulkhead initiator.

The pyrotechnic heat transfer initiator device of the invention provides a number of advantages over typical prior art initiator and delay devices currently in use, typically having only two or three main components and no moving parts, making the device simpler and less expensive to manufacture than prior art initiators and delays. In addition, the components of the heat transfer initiator can be adjusted to attain a wide range of delay times, and can be tied into the normal functioning of a munition to attain complete self-destruct, not just self-disable. Similar advantages are available for any system requiring a compact delay having a long function time. Therefore, where mission requirements for the self destruction of munitions have extended the required delay times to 30 seconds or longer, such delays are readily attainable with the heat transfer initiator of the invention. It is not generally feasible to attain such long delay times with prior art pyrotechnic initiators because the space required for such delays would exceed packaging constraints. Moreover, electronic initiators are costly and inherently less reliable because of their fragility, and mechanical initiators also suffer from reliability problems.

In contrast to prior art pyrotechnic delays, the time delay attainable with the heat transfer initiator of the invention does not depend on solely the burn rate and the column length of a pyrotechnic material, but, instead, is controlled by the time required to transfer the heat generated from a burning pyrotechnic material across a control medium (bridge) to an autoignition material to increase the temperature of the autoignition material to or above its autoignition temperature, resulting in the ignition of the autoignition material.

The heat transfer initiator of the invention typically may comprise two and, and in some applications, three components: a heat transfer control medium having a heat input portion and a heat output portion, where the heat output portion is in thermal contact with an autoignition material. Optionally, a pyrotechnic heat source is in thermal contact with the heat input portion. In many applications, an external heat source is available to provide the heat to the heat transfer control medium, and, thus, the optional pyrotechnic heat source is not required. However, in many applications, even where an external heat source is available, the optional pyrotechnic heat source may be desirable, as the optional pyrotechnic heat source can be selected to provide the amount of heat required to cause the initiator to function in a predetermined amount of time, and can be selected to initiate function of the heat transfer initiator at a specific temperature.

Figure 2:
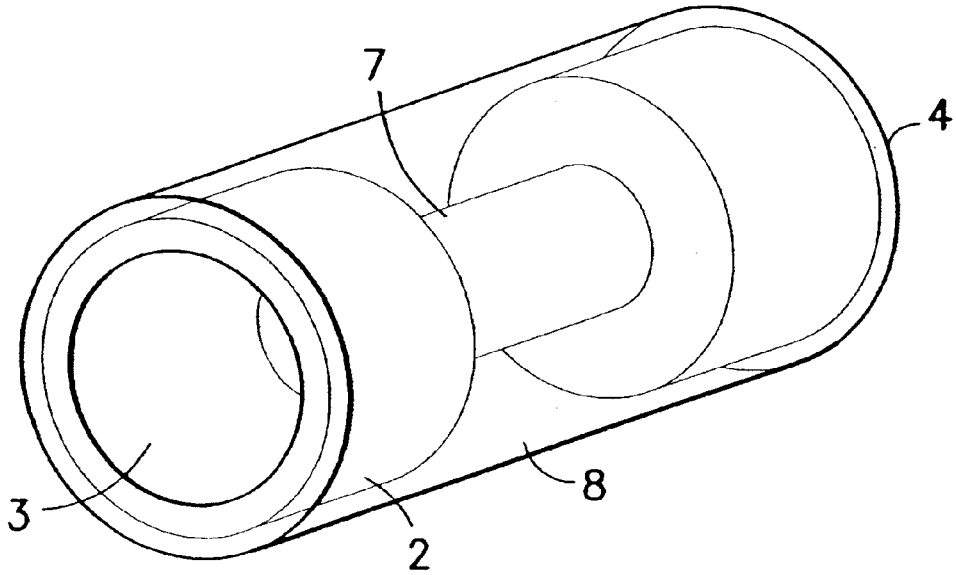
FIG. 2 is a perspective drawing of a heat transfer initiator of the invention.

Although the heat transfer initiator of the invention may take on any configuration that provides a reliable initiator, or, when desired a reliable, easily predetermined delay time, one embodiment of a simple heat transfer initiator may be obtained using the configuration depicted in FIGS. 1 and 2. The embodiment of the heat transfer initiator of the invention, 1, illustrated in FIGS. 1 and 2, comprises a heat transfer control medium in the form of a housing, 2, which may be a metal, alloy, ceramic, or any other suitable material, and optional cavities, 3 and 4, into which the optional pyrotechnic heat source, 5, which is typically a high heat output pyrotechnic composition, and an autoignition material, 6, which is preferably non-detonating, are typically placed. However, as will be recognized by those skilled in the art, cavities, 3, and, 4, and optional pyrotechnic heat source, 5, are not required in all applications. In applications where the cavities are not required, the optional pyrotechnic heat source, 5, the autoignition material, 6, or both may be applied to an end surface of the housing, 2, by any means known in the art, such as, e.g., by applying a coating of the material to the surface. Any appropriate binding material known in the art may be added to facilitate the attachment of either of the pyrotechnic materials to the surface of the housing.

In the embodiment illustrated in FIGS. 1 and 2, heat from the optional pyrotechnic heat source 5 is transferred to the autoignition material 6 through a thermal choke or heat transfer control bridge 7 which is part of the heat transfer control medium. Preferably, the housing 2 is surrounded by an insulating material 8 to prevent heat loss. Optionally, an appropriate ignition source 9 of any type well known in the art, including, but not limited to, an electric match, hot wire, or squib, may be placed in thermal contact with the optional pyrotechnic heat source 5 to provide the required initiation of the heat transfer initiator if no other ignition source is available in the particular application. However, in many applications, such as, e.g., fire suppression systems and sequential pyrotechnic devices, an external heat source is used to either ignite the optional pyrotechnic heat source or to provide the required heat directly to the heat input portion of the device.

In the embodiment illustrated in FIGS. 1 and 2, the heat transfer initiator of the invention functions as follows: the pyrotechnic heat source 5 is ignited, such as by the ignition source 9 or an external heat source. Heat from the combustion or reaction of the pyrotechnic heat source 5 is transmitted through the thermal choke 7 to the autoignition material 6 which is heated to its autoignition temperature, and ignites. Upon ignition, the output of the autoignition material 6 may be used to initiate the functioning of a variety of devices, including, but not limited to fire suppression systems, munitions primary initiation system or disable mechanism, or to initiate a variety of propellant, pyrotechnic, and explosive devices, systems, or stages.

Further embodiments of the heat transfer initiator of the invention, which may be particularly useful as delays, are depicted in FIGS. 3 to 6. The initiators depicted in FIGS. 3 to 6 comprise the optional pyrotechnic heat source. However, as noted above the optional pyrotechnic heat source is not required where an external heat source is available that will provide an amount of heat sufficient to activate the initiator of the invention when applied to the heat input portion of the heat transfer initiator. It will be understood by those skilled in the art that where such an outside heat source is available, the initiators depicted in FIGS. 3 to 6 may be readily modified to function without utilizing the optional pyrotechnic heat source or any of the illustrated cavities or cups used to hold the autoignition or the optional pyrotechnic heat source.

Figure 3:
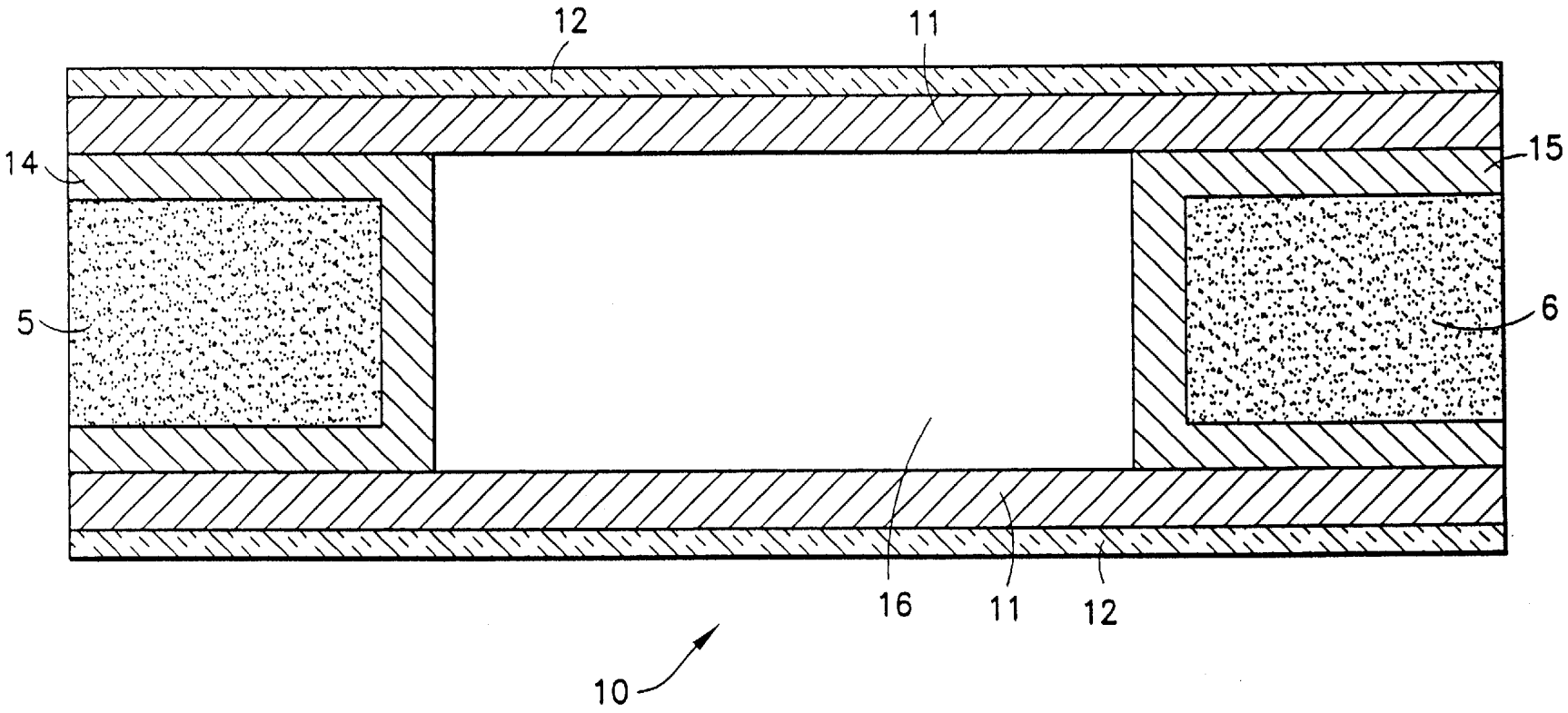
FIG. 3 is a cross sectional illustration of a heat transfer initiator of the invention.

As depicted in FIG. 3, an initiator 10 in accordance with the invention may comprise a thermally conductive tube 11, which functions as both the housing and the heat transfer control bridge, and, optionally is covered on its outer surface with an insulation material 12. Positioned in at least one end of the tube 11 is a preformed cup, formed from a thermally conductive material. The preformed cups 14 and 15 may be separated by air space 16, as depicted in FIG. 3, which, in part, may be used to provide and determine a delay time or time to function for the device. As with the heat transfer initiator illustrated in FIG. 1, one of the cups 14 contains a pyrotechnic heat source 5, which, when ignited, produces heat, which is transmitted through the cup 14 and thermally conductive tube 11 to the second cup 15, heating the autoignition material 6 to its autoignition temperature, igniting the autoignition material 6. Any delay time of initiator 10 is determined by the heat of reaction of the pyrotechnic heat source 5, the amount of heat source material, the thermal conductivity of tube 11 and cups 14 and 15, and the autoignition temperature of autoignition material 6.

Figure 4:
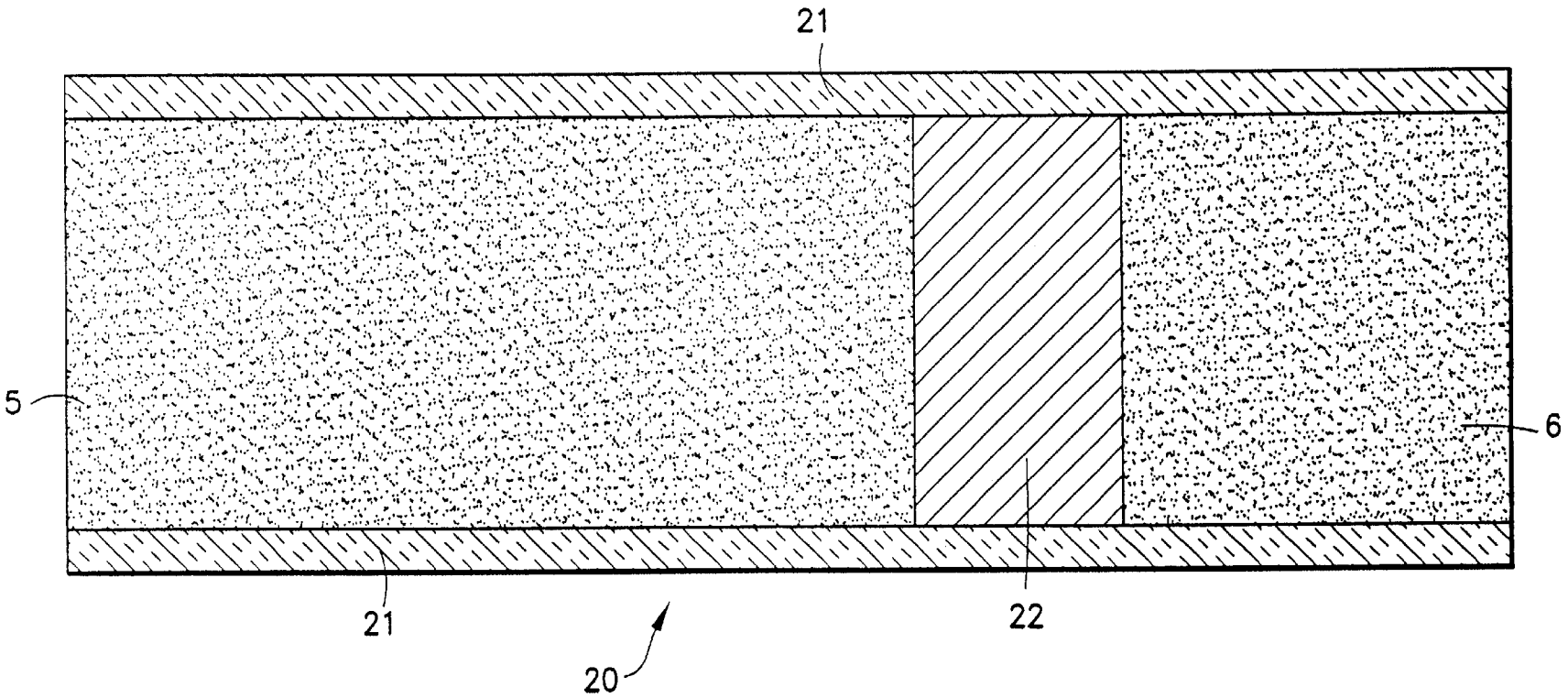
FIG. 4 is a cross sectional illustration of a heat transfer initiator of the invention.

FIG. 4 shows an initiator 20 comprising a tube of insulation material 21, a plug of thermally conductive material 22 situated within the tube 21, separating a pyrotechnic heat source 5 and a non-detonating autoignition material 6. Upon ignition of the heat source 5, heat is transmitted through the plug 22 to the autoignition material 6, heating the autoignition material to its autoignition temperature, causing the autoignition material to ignite.

Figure 5:
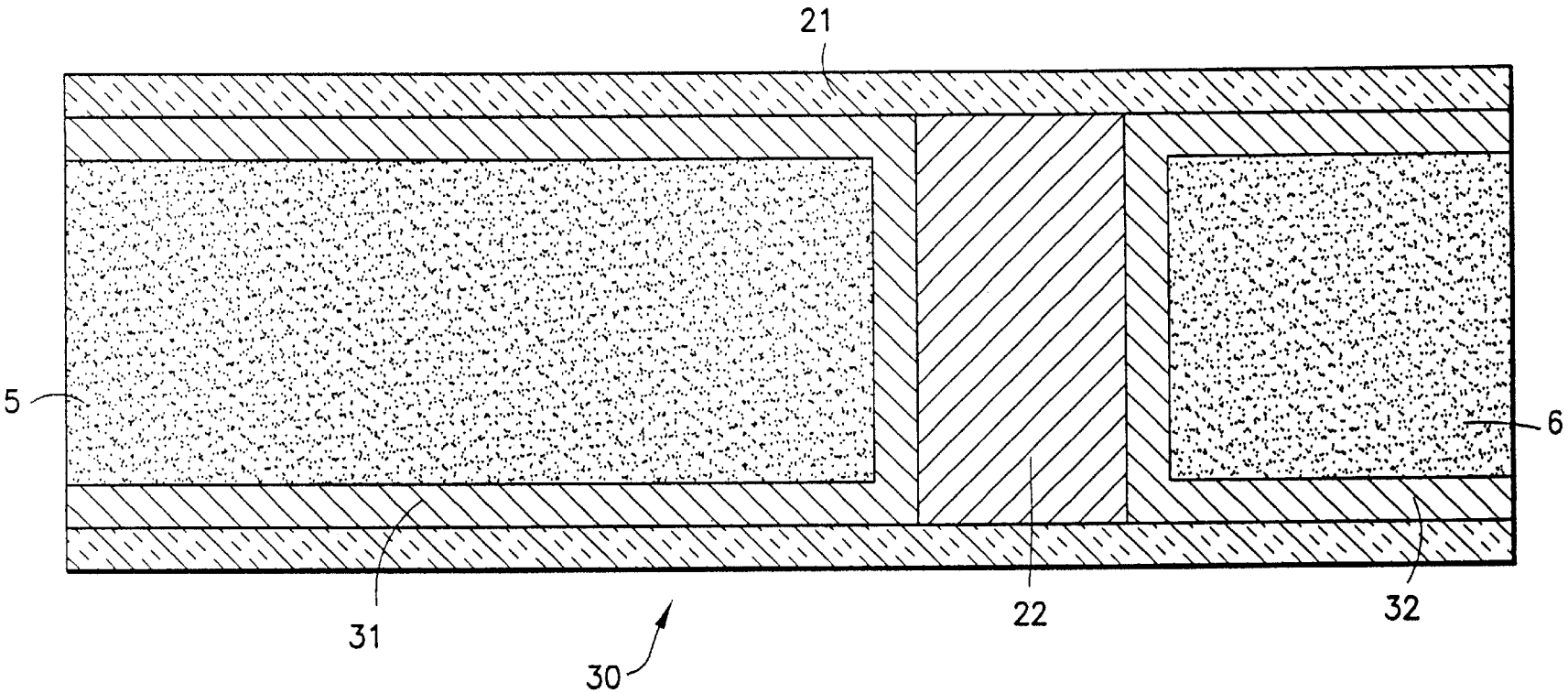
FIG. 5 is a cross sectional illustration of a heat transfer initiator of the invention.

Initiator 30, as depicted in FIG. 5, is similar to the initiator depicted in FIG. 4 except that the pyrotechnic heat source 5 and autoignition material 6 are placed in preformed, thermally conductive cups 31 and 32, respectively, which are inserted into a tube of insulation material 21, such that the cups 31 and 32 are separated by and in thermal contact with a plug of thermally conductive material 22. When the pyrotechnic heat source 5 is ignited, the heat generated is transmitted through cup 31, plug 22, and cup 32, heating autoignition material 6 to its autoignition temperature, causing autoignition material 6 to ignite. Any delay time of initiator 30 is determined by the heat of reaction and the amount of pyrotechnic heat source material 5, the thermal conductivity and thickness of cups 31 and 32 and of plug 22, and the autoignition temperature of autoignition material 6.

Figure 6:
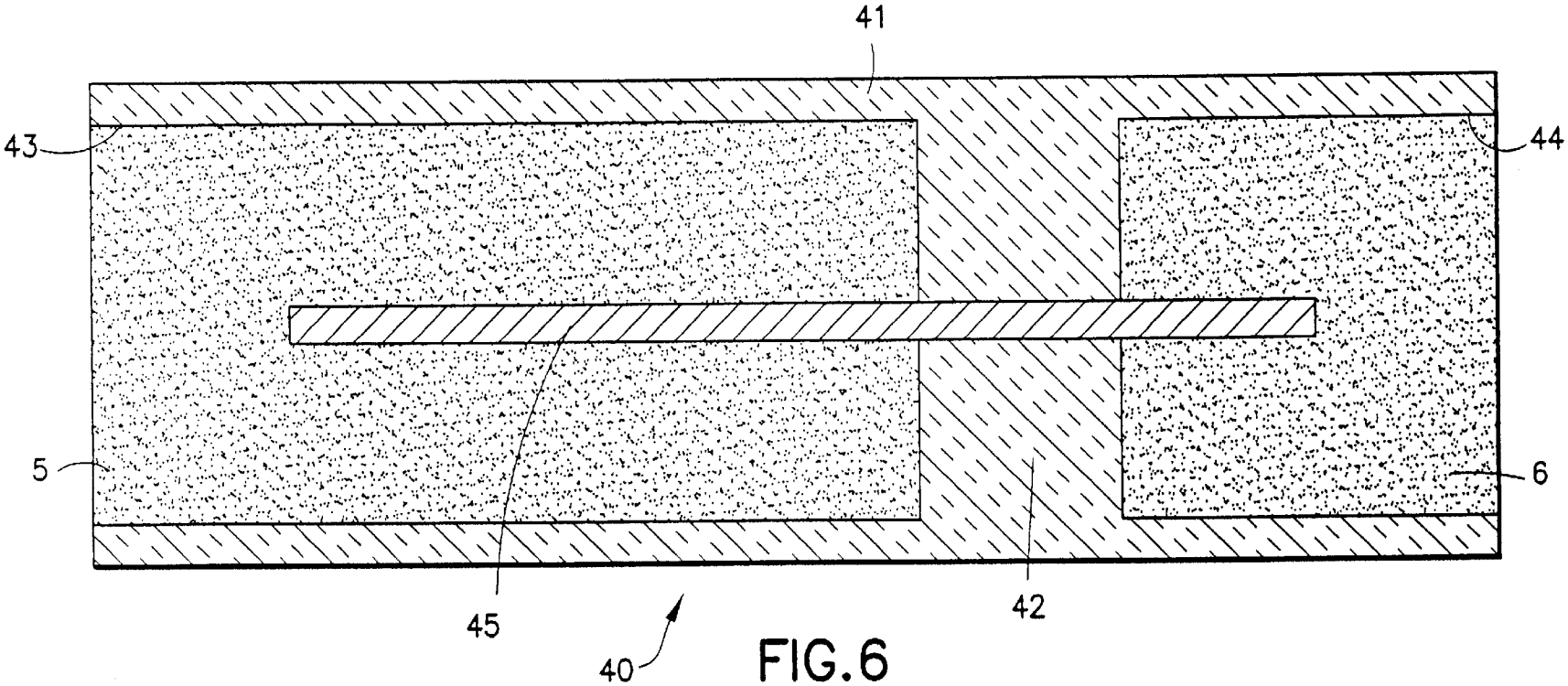
FIG. 6 is a cross sectional illustration of a multiple-functioning heat transfer initiator of the invention.

The initiator 40, as depicted in FIG. 6, comprises an outer tube of insulation material 41 and a plug of insulation material 42, which may be a separate piece of material, inserted into tube 41, or may be formed of a single piece with tube 41. The tube 41 and the plug 42 form two cavities 43 and 44, which contain the pyrotechnic heat source 5 and autoignition material 6. A rod 45 of a thermally conductive material is situated in plug 42, such that one portion of rod 45 is in thermal contact with the heat source 5 and another portion is in thermal contact with the autoignition material 6. When the heat source 5 is ignited, heat is transmitted through the rod 45, heating the autoignition material 6 to its autoignition temperature, igniting the autoignition material 6. Any delay time of initiator 40 is determined by the heat of reaction and the amount of pyrotechnic heat source material 5, the thermal conductivity and thickness of rod 45, the thickness of plug 42, and the autoignition temperature of autoignition material 6. In a similar embodiment, where the pyrotechnic heat source material 5 is not required, the rod 45 may be used alone as the heat input portion of the initiator, or may be embedded in a heat conducting material filling cavity 43 in place of the pyrotechnic heat source material 5, such that the heat conducting material and the rod 45 together function as the heat input portion of the device.

Figure 7:
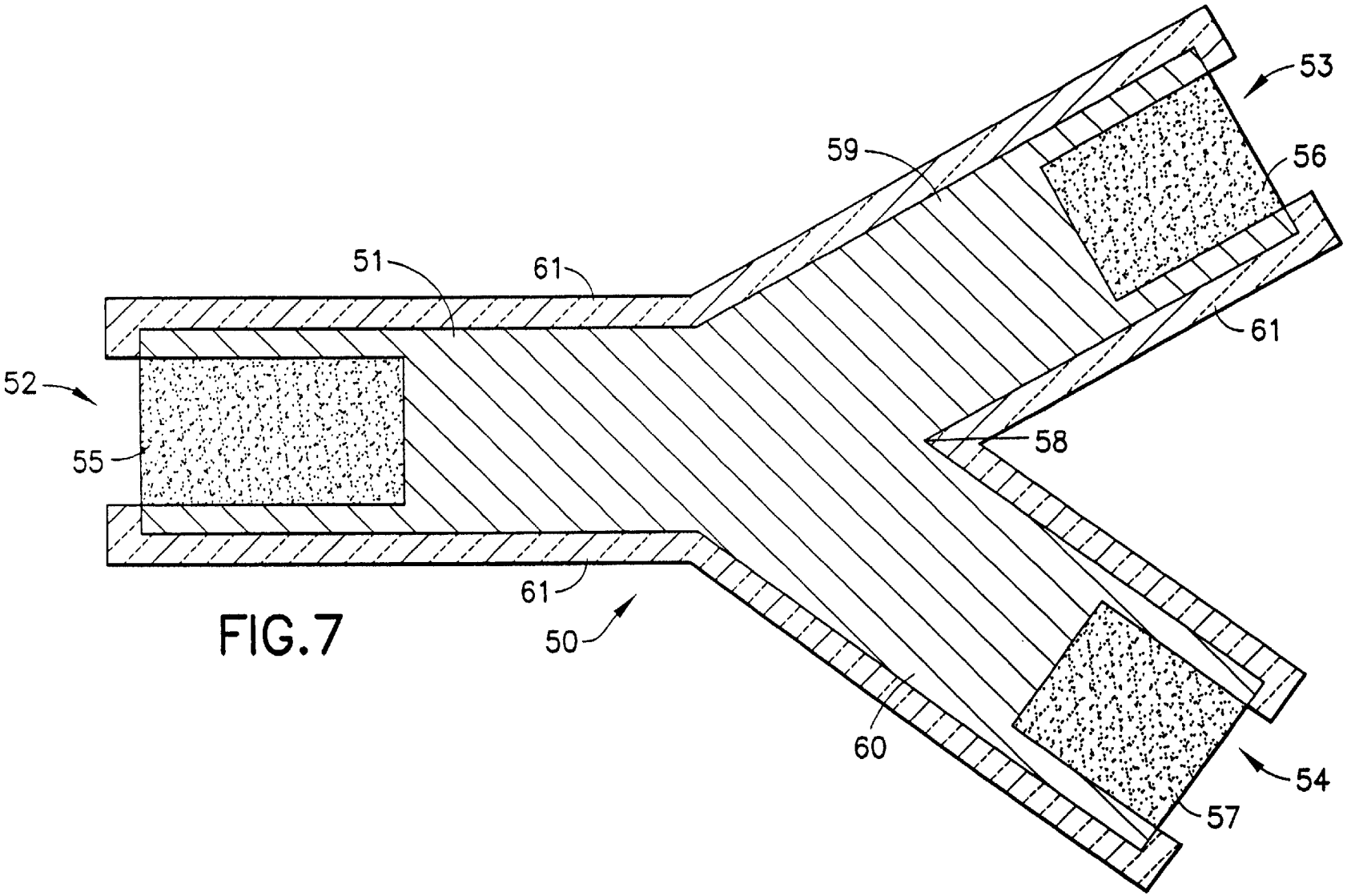
FIG. 7 is a cross sectional illustration of one embodiment of a multiple-functioning heat transfer initiator of the invention.

Multiple functioning initiators and sequential initiators can also be provided with the present invention. Multiple functioning initiators may be obtained, e.g., by branching the heat transfer control medium of the initiator as depicted in FIG. 7. initiator 50, as depicted in FIG. 7, comprises a housing 51 formed from a thermally conductive material, and defines cavities 52, 53, and 54, which contain a pyrotechnic heat source material 55 and autoignition materials 56 and 57. The housing is branched at 58, forming branches 59 and 60, and is optionally covered with a layer of insulating material 61. Upon ignition, heat source 55 produces heat that is transmitted through the housing 51 and branches 59 and 60, heating autoignition materials 56 and 57 to their autoignition temperature. As will be understood by one of skill in the art, autoignition materials 56 and 57 may be ignited virtually simultaneously by using the same autoignition material in each of cavities 53 and 54, where branch 59 has the same length as branch 60. In the alternative, two different autoignition materials, having different autoignition temperatures, and/or branches 59 and 60 may have different lengths and/or be formed from materials having different thermal conductivities, so that the autoignition materials do not ignite simultaneously.

Figure 8:
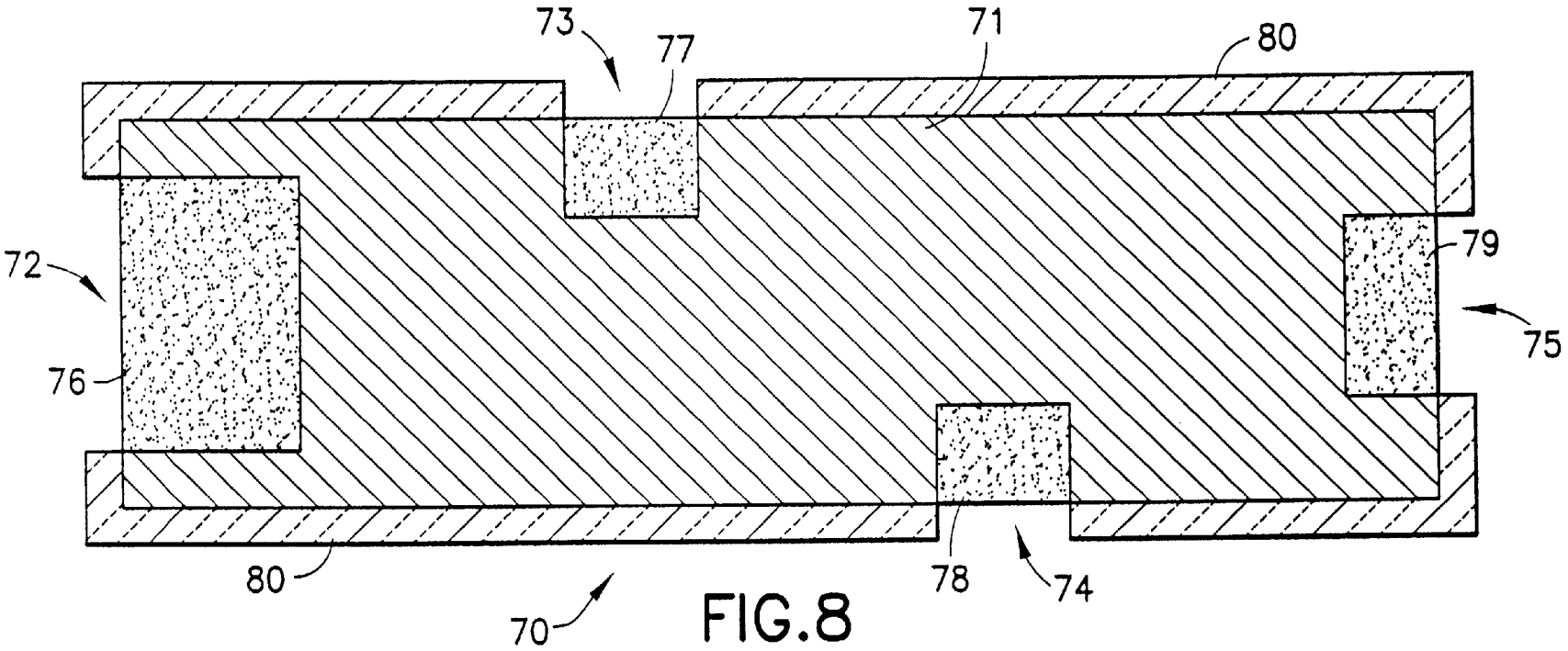
FIG. 8 is a cross sectional illustration of a further embodiment of a multiple-functioning heat transfer initiator of the invention.

Alternatively, as depicted in FIG. 8, a initiator 70, having an unbranched housing 71 and multiple cavities 72, 73, 74, and 75 may be used. The housing 71 is optionally covered with a layer of insulating material 80. The pyrotechnic heat source material 76 may be placed in any of the cavities, and an autoignition material 77, 78, 79, which may be the same or different, is placed into the other cavities. Upon ignition of heat source 76, the heat produced is transmitted through the housing 71, which acts as the heat transfer control medium, heating the autoignition materials 77, 78, and 79 to their autoignition temperature, igniting each autoignition material. As will be understood by one of ordinary skill in the art, the position of the cavities 72, 73, 74, and 75 and the autoignition materials 73, 74, and 75 may be chosen so that the functioning of the autoignition materials is simultaneous or sequential. The timing of the functioning of each autoignition material in a initiator may also be controlled by placing the autoignition material in a thermally conductive cup (not shown) that is inserted into any of the cavities. If cups having different thermal conductivities are used with either of the initiators 50 and 70 depicted in FIGS. 7 and 8, any delay time for the functioning of each autoignition material can be further controlled.

As will also be understood by one of skill in the art, multiple functioning initiators in accordance with the invention are not limited to those depicted in the Figures, which are for illustrative purposes only. Other multifunctioning initiators may be, e.g., obtained using the basic initiators depicted in the other Figures.

In addition, the output of one initiator may be used to ignite the pyrotechnic heat source of one or more other initiators, by placing the output of the first initiator sufficiently close to the heat source of the other initiator or initiators, such that, upon functioning, the output of the first initiator ignites the heat source of the other initiator or initiators. Placing two or more initiators sequentially in this manner allows delay times longer than could be obtained with a single initiator.

As noted above, the heat transfer initiator of the invention is particularly useful as a through-bulkhead initiator, and, as such, maybe used to initiate the function of a fire suppression system, either as the primary or secondary initiator, successive stages in a train of pyrotechnic devices, including, but not limited to rocket staging, and any other application where a thermal output on one side of a barrier, such as a bulkhead, firewall, or other type of wall, is required in response to a thermal input on the other side of the barrier without breaching the barrier.

In many applications, any of the heat transfer initiators illustrated in FIGS. 1 to 8 may be used as a TBI by inserting the heat transfer initiator through a hole in the bulkhead, and sealing the heat transfer initiator into the hole with any appropriate sealing method and/or material known in the art.

However, in some applications, where the initiator must function in response to an increase in temperature, the optional pyrotechnic heat source is not required. In such applications, such as, e.g., the initiator of a fire suppression system, an increase in temperature at the heat input end of the heat transfer initiator causes a transfer of heat through the heat transfer control medium, which heats the autoignition material to a temperature greater than the autoignition temperature of the autoignition material, causing the autoignition material to ignite.

However, the use of a pyrotechnic heat source allow the heat transfer initiator of the invention to more readily function at a specific predetermined temperature in such applications. By selecting a pyrotechnic heat source having an autoignition temperature that corresponds to the temperature at which initiative is required. For example, to initiate a fire suppression system within a compartment at a predetermined temperature, the heat transfer initiator would comprise a pyrotechnic heat source having an autoignition temperature equal to the predetermined temperature. In the alternative, the heat transfer initiator can be configured to allow the input of heat in the compartment into the heat transfer initiator. When the temperature within the compartment was sufficiently high, such as when equipment overheats, ambient heat would be transferred through the heat transfer to the autoignition material, igniting the autoignition material.

Figure 9:
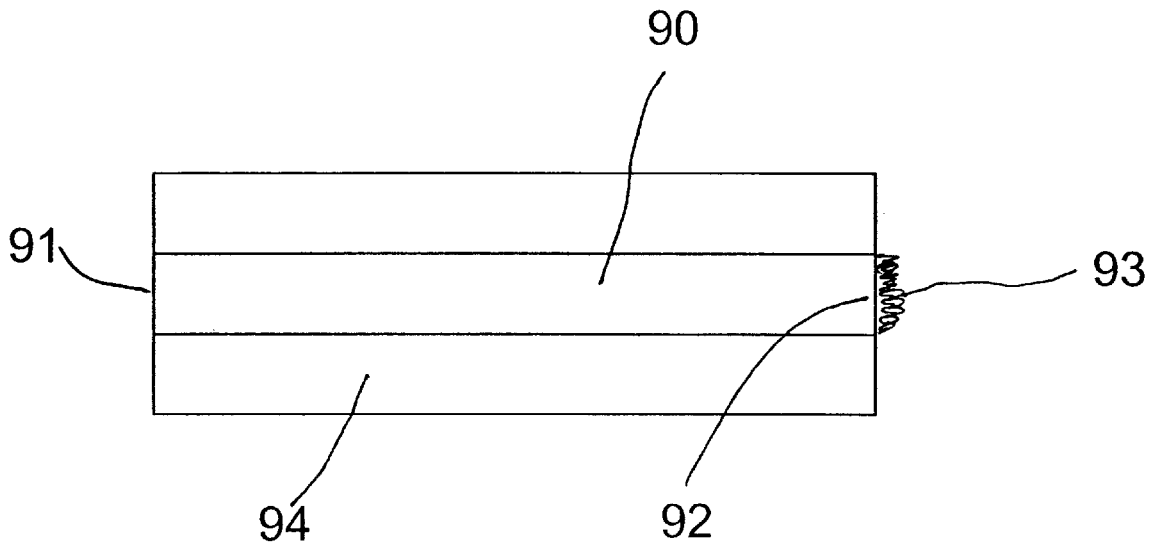
FIG. 9 is a cross sectional illustration of a further embodiment of a heat transfer initiator of the invention.

In its simplest embodiment, as depicted in FIG. 9, the heat transfer initiator of the invention is formed from a heat conducting rod 90 having a first heat input end 91 and a second heat output end 92, where heat output end is in thermal contact with a layer 93 of autoignition material. Optionally, a layer of a pyrotechnic heat source (not shown) may be placed in thermal contact with heat input end 91. Optionally, as discussed above, rod 90 may be covered with a layer of insulating material 94 to prevent heat loss.

Figure 10:
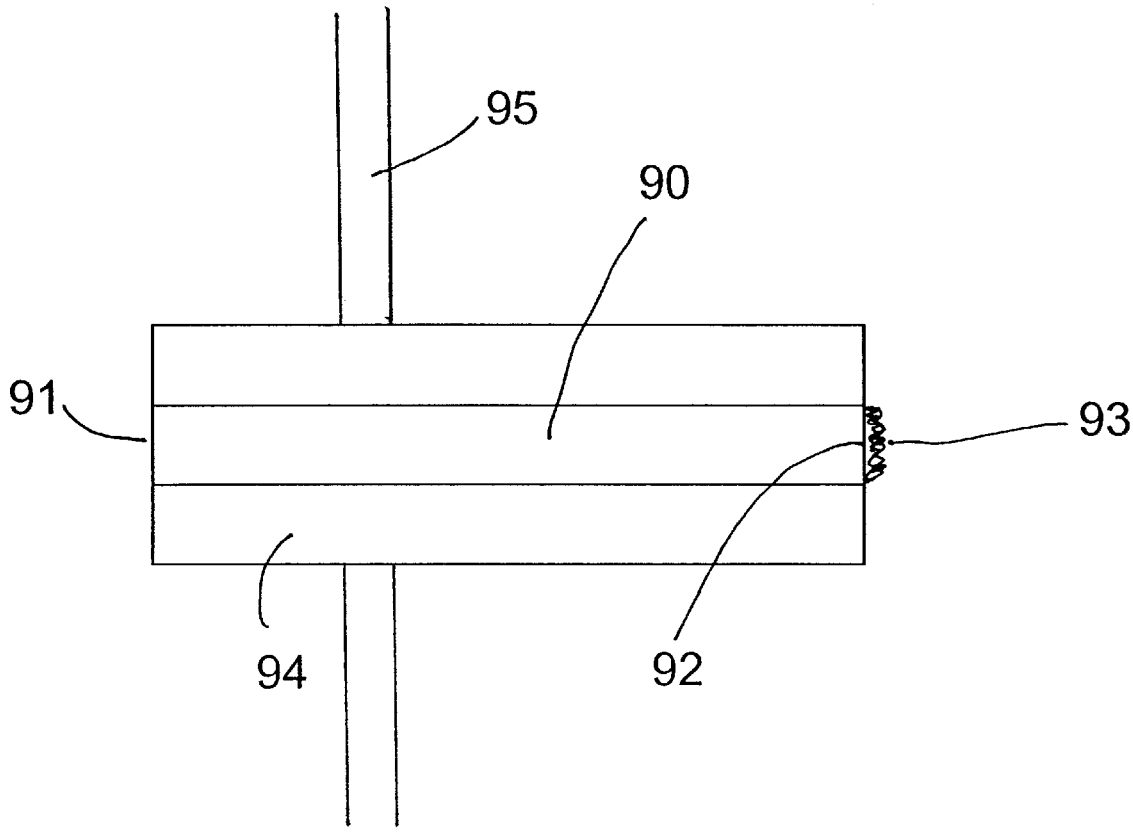
FIG. 10 is a cross sectional illustration of a heat transfer initiator of the invention used as a through-bulkhead initiator.

As depicted in FIG. 10, the heat transfer initiator of FIG. 9, as well as the heat transfer initiators of FIGS. 1 to 8, may be used as a through bulkhead initiator. In this embodiment, the heat transfer initiator is inserted into a corresponding hole in a bulkhead or other barrier 95 in such a manner that the hole is sealed. As the bulkhead 95 may act as a heat sink, the use of insulation 94 is preferred in this application. Although rod 90 is depicted as protruding from both sides of bulkhead 95 in FIG. 10, it will be recognized that either or both of ends 91 and 92 may be flush with either surface of bulkhead 95, or, where bulkhead 95 is sufficiently thick, may be depressed relative to the bulkhead surface. Rod 90 may also be replaced with a disk having a thickness that may be greater than, equal to, or less than the thickness of bulkhead 95.

Figure 11A:
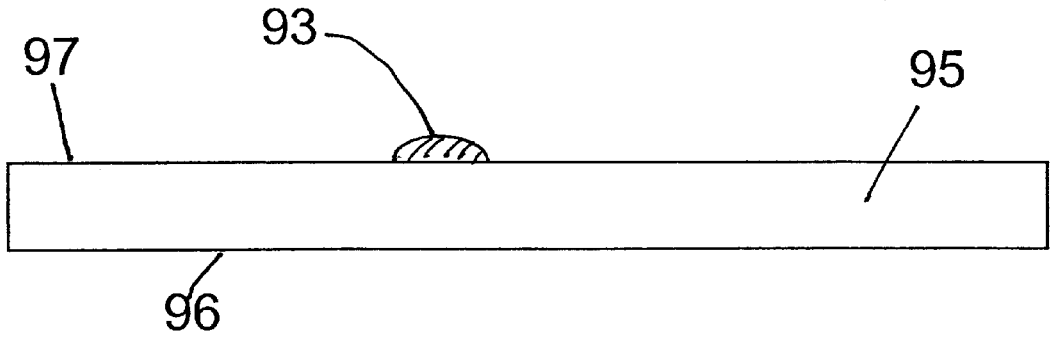
FIG. 11 is a cross sectional illustration of a further embodiment of a heat transfer initiator of the invention used as a through-bulkhead initiator.
Figure 11B:
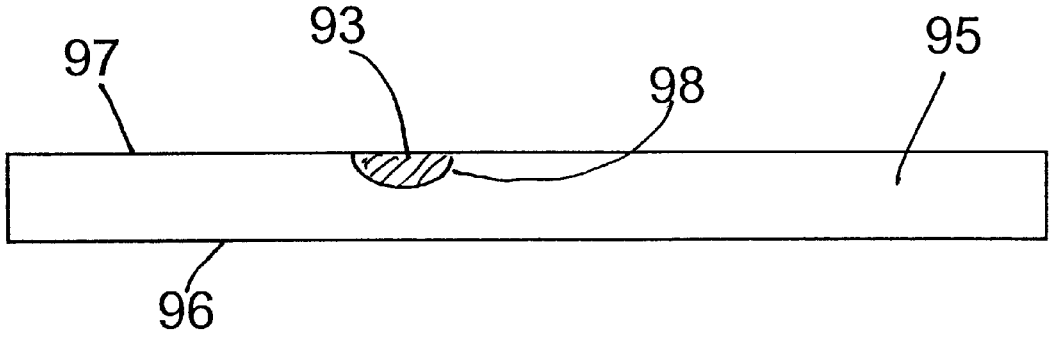
Figure 11C:
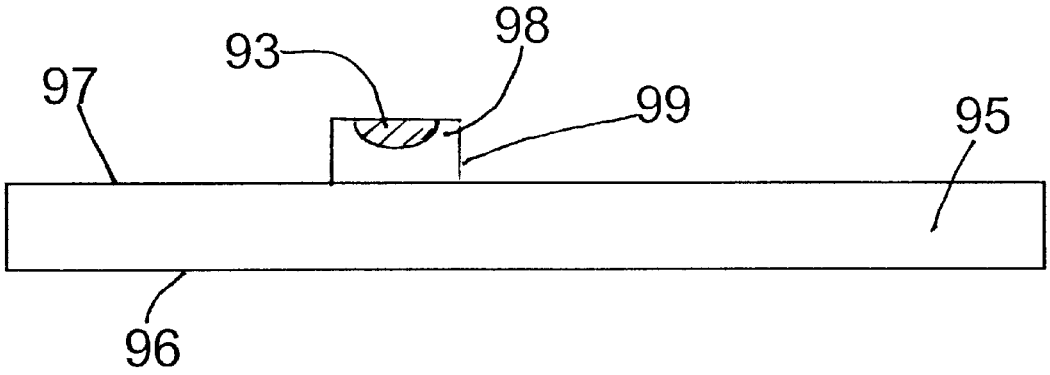
Figure 12:
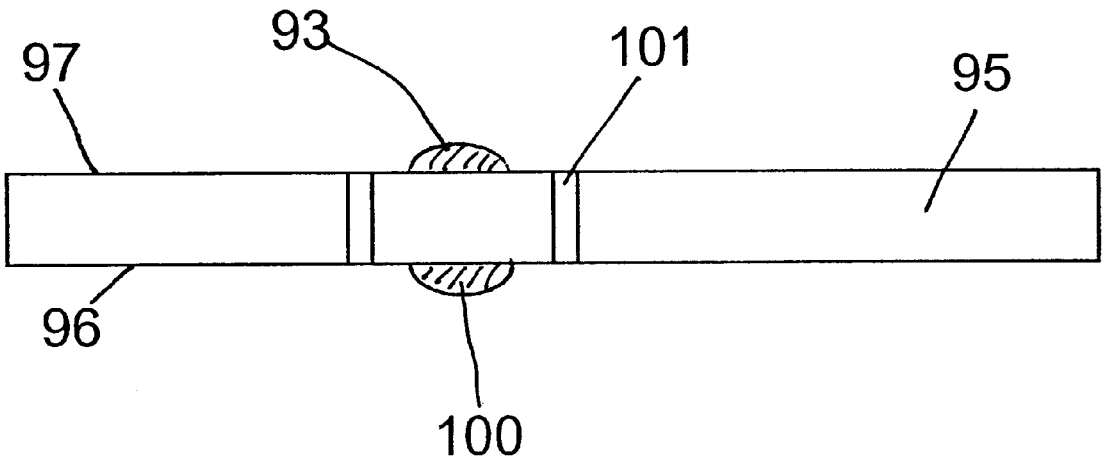
FIG. 12 is a cross sectional illustration of a further embodiment of a heat transfer initiator of the invention used as a through-bulkhead initiator.

As depicted in FIGS. 11A, 11B, and 11C and in FIG. 12, in certain applications, bulkhead 95 may be used as the heat transfer control medium for the heat transfer initiator. As depicted in FIG. 11A, an autoignition material 93 is applied to one side 97 of a bulkhead 95. When bulkhead 95 is heated, either on side 96, opposite autoignition material 93, or at some point on side 97, to a temperature equal to or greater than the autoignition temperature of autoignition material 93, the autoignition material will ignite. In a further embodiment, as shown in FIG. 11B, autoignition material 93 may be placed in a depression or cup 98 in side 97 of bulkhead 95. In yet a further embodiment, a heat conducting autoignition material holder 99 may be attached to side 97 of bulkhead 95. The autoignition material 93 is placed in thermal contact with the holder 99, such as in a depression or cup 98, as shown in FIG. 11C.

Similarly, as depicted in FIG. 12, a pyrotechnic heat source 100 may be placed in thermal contact with side 96 opposite the autoignition material 93 on side 97 of bulkhead 95. When the pyrotechnic heat source 100 is ignited, such as by heating or an igniter (not shown), the heat generated by pyrotechnic heat source 100 is transferred through the bulkhead 95, and ignites autoignition material 93. Cavities 98 and holders 99, such as those shown in FIGS. 11B and 11C, may also be used in this embodiment to hold one or both of the autoignition material 93 and the pyrotechnic heat source 100. To reduce or prevent the conduction of heat through the bulkhead 95 and away from autoignition material 93, which could prevent autoignition material 93 from reaching its autoignition temperature, an optional ring of insulating material 101 may be placed in bulkhead 95, as shown in FIG. 12. Useful insulating materials include, but are not limited to ceramics, filled epoxy resins, glasses, composites, paints, laminates, non-heat-conductive polymers, expanded polytetrafluoroethylene, natural and synthetic rubbers, urethanes, and heat resistant composites.

The optional pyrotechnic heat source may be any pyrotechnic material capable of producing the required amount of heat. Pyrotechnic heat sources include any and all materials that produce heat through a chemical reaction. Pyrotechnic heat sources are categorized by the type of chemical reactions that each undergoes. Useful pyrotechnic heat sources are well known in the art, and include, but are not limited to, thermites, thermates, delay compositions, halogenated compositions, torch/flare compositions, igniter compositions, and intermetallic compositions. See, Ellern, *Military and Civilian Pyrotechnics,* Chemical Publishing Company Inc., 1968.

Those pyrotechnic materials that generate heat through the reaction of a metal ($M_1$) with a metal oxide ($M_2O$) are generally referred to as thermites, where the reaction may be represented by:

$$M_1+M_2O \rightarrow M_2+M_1O.$$

It is important to note that $M_1$, $M_2$, $M_1O$, and $M_2O$ in this expression do not represent the stoichiometry of the reaction but, instead, represent any metal or metal oxide, such as Fe, Cu, $Fe_2O_3$, or CuO. The formulas and properties of some representative thermites are provided in TABLE 1 for illustration purposes only.

TABLE 1

REPRESENTATIVE THERMITE COMPOSITIONS.

| Formula (%, wt/wt) | Theoretical Flame Temperature (C. °) | Heat of Reaction (cal/g) | Heat Density (cal/cm$^{-3}$) | Pressed Density (g/cm$^3$) |
|---|---|---|---|---|
| 27.3 Al + 72.7 $MoO_3$ | 2980 | −1124 | −4279 | 3.81 |
| 43.7 Al + 56.3 $B_2O_3$ | 2054 | −781 | −1971 | 2.52 |
| 11.9 B + 88.1 $Fe_2O_3$ | 1792 | −590 | −2751 | 4.67 |
| 31.0 Ti + 69.0 $Fe_2O_3$ | 2341 | −612 | −3066 | 5.01 |
| 66.3 Zr + 33.7 $B_2O_3$ | 2300 | −437 | −1654 | 3.78 |
| 45.1 Zn + 54.9 CuO | 1927 | −496 | −3368 | 6.79 |

Pyrotechnic materials that generate heat through the reaction of a metal ($M_1$) with a metal oxide ($M_2O$) in the presence of an additional, more energetic, oxidizer, such as potassium perchlorate (KP), $KClO_4$; sodium perchlorate, $NaClO_4$; sodium chlorate, $NaClO_3$; potassium nitrate (KN), $KNO_3$; sodium nitrate, $NaNO_3$; sodium dichromate, $Na_2Cr_2O_7$; potassium dichromate, $K_2Cr_2O_7$; or potassium permanganate, $KMnO_4$; are generally referred to as thermates, where the reaction, with potassium perchlorate for example, may be represented by:

$$M_1+M_2O+KClO_4 \rightarrow M_2+M_1O+KCl.$$

Again, as noted above, $M_1O$ and $M_2O$ in this expression do not represent the stoichiometry, but, instead, represent any metal oxide such as $Fe_2O_3$or CuO. The formulas and properties of some representative thermates are provided in TABLE 2 for illustration purposes only.

TABLE 2

REPRESENTATIVE THERMATE COMPOSITIONS.

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 30.8 Al + 35.3 $MoO_3$ + 33.9 KP | 3377 | −808 | −2700 | 3.34 |
| 37.7 Al + 20.8 $B_2O_3$ + 41.5 KP | 2630 | −696 | −1663 | 2.39 |
| 14.5 B + 45.8 $Fe_2O_3$ + 39.7 KP | 2219 | −512 | −1654 | 3.23 |
| 52.9 Ti + 25.2 $Fe_2O_3$ +21.9 KP | 2845 | −555 | −2187 | 3.94 |
| 75.4 Zr + 8.2 $B_2O_3$ + 16.4 KP | 3222 | −442 | −1936 | 4.38 |
| 60.0 Zn + 14.6 CuO + 25.4 KP | 1874 | −262 | −1534 | 5.86 |

A pyrotechnic composition that bums at a reproducible rate, and is used to produce a time delay between initiation and output is generally referred to as a delay composition. Delay compositions are ideal candidates for the optional pyrotechnic heat source of the heat transfer initiator, such as delay compositions comprising a metal fuel, such as molybdenum, tungsten, boron or tantalum, and a blend of oxidizers, such as a metal chromate, $M_1CrO_4$, and potassium perchlorate (KP), $KClO_4$, and often contain a binder, such as vinyl alcohol acetate resin (VAAR). The reaction of such a delay composition may be represented by:

$$M_1+M_2CrO_4+KClO_4 \rightarrow M_1O+M_2O+KCl+Cr_2O_3,$$

where, again, $M_1O$ and $M_2O$ do not represent the stoichiometry, but, instead, represent any metal oxide, such as $Fe_2O_3$or CuO. Formulas and properties of some representative delay compositions are provided in TABLE 3 for illustration purposes only.

TABLE 3

REPRESENTATIVE DELAY COMPOSITIONS

| Formula (%, wt/wt) | Theoretical Flame Temperature (C°) | Heat of Reaction (cal/g) | Heat Density (cal/cm$^3$) | Pressed Density (g/cm$^3$) |
|---|---|---|---|---|
| 55.0 Mo + 40.0 $BaCrO_4$ + 5.0 $KClO_4$ | 1339 | −149 | −1123 | 7.53 |
| 55.0 Mo + 35.0 $NH_4ClO_4$ + 10.0 $(NH_4)_2Cr_2O_7$ | 2168 | −419 | −2727 | 6.51 |
| 45.0 W + 40.5 $BaCrO_4$ + 14.5 $KClO_4$ | 1775 | −372 | −2135 | 5.74 |
| 44.5 Ta + 39.5 $BaCrO_4$ + 15.0 $KClO_4$ + 1.0 VAAR | 2567 | −310 | −1760 | 5.68 |
| 26.0 Zr/Ni (30/70 alloy) + 60.0 $BaCrO_4$ + 14.0 $KClO_4$ | 1340 | −521 | −2350 | 4.51 |
| 10.0 B + 89.0 $BaCrO_4$ + 1.0 VAAR | 1647 | −316 | −1293 | 4.11 |

Halogenated compositions, such as mixtures of magnesium and TEFLON® with VITON® or magnesium and TEFLON® with silicone, release energy from the fluorination of the metal. The general reaction equation for a stoichiometric mixture of 32.7 percent by weight Magnesium and 67.3 percent by weight TEFLON® is $$2n\mathrm{Mg}+(C_2F_4)_n \rightarrow 2n\mathrm{MgF}_2+2n\mathrm{C},$$

where n is generally an integer. Similarly, when a VITON® ($C_{10}H_7F_{13}$) binder is added to the reaction/combustion, the reaction products are $MgF_2$, HF and C. Formulas and properties of some representative fluorinated compositions are provided in TABLE 4 for illustration purposes only.

TABLE 4

REPRESENTATIVE HALOGENATED COMPOSITIONS

| Formula (%, wt/wt) | Theoretical Flame Temperature (° C.) | Heat of Reaction (cal/g) | Heat Density (cal/cm3) | Pressed Density (g/cm$^3$) |
|---|---|---|---|---|
| 65.0 Mg + 30.0 Teflon ® + 5.0 Viton ® A | 1650 | −1150 | −1955 | 1.70 |
| 37.0 Mg + 26.0 Teflon ® + 37.0 Silicone | 1593 | −632 | −904 | 1.43 |

Torch and flare compositions typically include magnesium as a fuel component, as magnesium burns hot and brightly, but may also use other metals as the fuel, such as titanium, zirconium and silicon. Compositions containing magnesium and TEFLON®, such as those provided as an example of a halogenated pyrotechnic composition, are also considered a part of this class. A representative equation for the reaction of torch and flare compositions is $$5\mathrm{Mg}+2\mathrm{NaNO}_3 \rightarrow 5\mathrm{MgO}+\mathrm{Na}_2\mathrm{O}+\mathrm{N}_2.$$

Formulas and properties of some representative torch/flare compositions are provided in TABLE 5 for illustration purposes only.

TABLE 5

REPRESENTATIVE TORCH/FLARE COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 58.0 Mg + 42.0 $NaNO_3$ | 2832 | 1621 | 3112 | 1.92 |
| 30.0 Mg + 30.0 $Ba(NO_3)_2$ + 10.0 $KClO_4$ + 1.0 VAAR | 2972 | 638 | 1608 | 2.52 |
| 40.0 Mg + 35.0 $Ba(NO_3)_2$ + 10.0 $KClO_4$ + 15.0 CuO | 2832 | 570 | 1942 | 3.41 |
| 24.0 Zr + 34.0 Si + 16.0 $Fe_2O_3$ 24.0 $KClO_4$ + 2.0 $Na_2SiO_3$ | 2260 | 1020 | 2550 | 2.50 |

Igniter compositions, which are typically used in the ignition train of many pyrotechnic devices to enable or enhance ignition of the main charge, have a high heat output that also makes them suitable for use in the heat transfer initiator of the invention. These mixtures often contain a metallic fuel mixed with a perchlorate oxidizer. Representative reactions for this group of compositions include $$2\mathrm{Zr}+\mathrm{KClO}_4 \rightarrow 2\mathrm{ZrO}_2+\mathrm{KCl},$$

and $$2\mathrm{Ti}+\mathrm{KClO}_4 \rightarrow 2\mathrm{TiO}_2+\mathrm{KCl}.$$

Formulas and properties of some representative igniter compositions are provided in TABLE 6 for illustration purposes only.

TABLE 6

REPRESENTATIVE IGNITER COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 24.5 B + 74.5 $KClO_4$ + 1.0 VAAR | 1866 | −659 | −1595 | 2.43 |
| 65.0 Zr + 25.0 $Fe_2O_3$ + 10.0 Diatomaceous Earth + 1.0 VAAR | 2440 | −4888 | −4815 | 1.67 |
| 50.0 Zr + 50.0 $KClO_4$ | 3699 | −568 | −2050 | 3.61 |
| 50.0 Al + 50.0 $KClO_4$ | 3331 | −827 | −2158 | 2.61 |
| 50.0 Ti + 50.0 $KClO_4$ | 3435 | −653 | −2108 | 3.23 |
| 49.0 B + 49.0 $KNO_3$ + 2.0 Binder | 2297 | −651 | −1412 | 2.17 |

Intermetallics are pyrotechnics that generate large amounts of heat with little or no gas generation. The energy released by intermetallics is derived from the alloying process, which involves the forming of new metal-metal bonds that are at a lower energy state than the pure metals. Representative reactions for this group of compositions include $$2B+Ti \rightarrow B_2Ti,$$

$$2B+Zr \rightarrow B_2Zr,$$

and $$Al+Ni \rightarrow AlNi.$$

Formulas and properties of some representative intermetallic compositions are provided in TABLE 7 for illustration purposes only.

TABLE 7

REPRESENTATIVE INTERMETALLIC COMPOSITIONS

| Formula (%, wt/wt) | Theoretical Flame Temperature (° C.) | Heat of Reaction (cal/g) | Heat Density (cal/cm$^3$) | Pressed Density (g/cm$^3$) |
|---|---|---|---|---|
| 47.1 B + 52.9 Mg | 1433 | −479 | −972 | 2.03 |
| 55.5 Al + 45.5 B | 979 | −742 | −1940 | 2.61 |
| 19.2 B + 80.8 Zr | 3400 | −683 | −3360 | 4.93 |
| 31.5 Al + 68.5 Ni | 1637 | −330 | −1710 | 5.17 |
| 28.2 B + 71.8 Mn | 1113 | −294 | −1390 | 4.73 |
| 18.4 B + 81.6 Mo | 1260 | −196 | −1280 | 6.10 |
| 18.4 B + 81.6 Ti | 3225 | −1320 | −5170 | 3.60 |
| 12.8 B + 87.2 W | 960 | −83.0 | −1350 | 10.37 |

Preferably, the pyrotechnic material used for the pyrotechnic heat source is one of a mixture of titanium, amorphous boron, and barium chromate, most preferably about 46.67 percent by weight titanium, about 23.33 percent by weight amorphorous boron, and about 30 percent by weight barium chromate, or a mixture of tungsten, barium chromate, potassium perchlorate, and vinyl alcohol acetate resin, most preferably about 45 weight percent tungsten, about 40.5 weight percent barium chromate, about 14.5 weight percent potassium perchlorate, and about 1 weight percent vinyl alcohol acetate resin.

With regard to the autoignition material, 6, for the purpose of this invention, the terms "autoignition material" and "AIM" refer to any material that ignites without an external ignition source when its temperature is raised above a certain threshold temperature, i.e., its ignition or autoignition temperature, which is preferably less than about 250° C. Therefore, the autoignition material may be any material that will autoignite, preferably without detonating, when the heat from the pyrotechnic heat source, 5, is transmitted through the thermal choke, 7, to the autoignition material, 6, raising the temperature of the autoignition material, 6, to or above its autoignition temperature. Useful autoignition materials that autoignite in the range of 175–225° C., and are preferably non-detonating, include nitrocellulose, nitroglycerine based smokeless gun powders, safety and strike anywhere match compositions, smoke compositions, friction primer compositions, plastic bonded starter compositions, white smoke compositions, sugar based compositions and diazidodinitrophenol (DDNP) compositions. However, the most preferred non-detonating autoignition materials are mixtures of an oxidizer composition and a powdered metal fuel, such as the autoignition materials disclosed in U.S. patent application Ser. No. 08/791,176, filed Jan. 30, 1997, now U.S. Pat. No. 5,739,460, in U.S. patent application Ser. No. 08/645,945, filed May 14, 1996, in U.S. patent application Ser. No. 09,010,823, filed Jan. 22, 1998, now U.S. Pat. No. 6,101,947, and in U.S. patent application Ser. No. 09/010,822, filed Jan. 22, 1998, the contents of which are incorporated herein by reference to the extent necessary to supplement this specification.

Oxidizer compositions useful with powdered metal fuels in the non-detonating autoignition materials useful in the invention include, but are not limited to, compositions comprising alkali metal nitrates, alkaline earth metal nitrate complex salt nitrates, dried, hydrated nitrates, silver nitrate, alkali metal chlorates, alkali metal perchlorates, alkaline earth metal chlorates, alkaline earth metal perchlorates, ammonium perchlorate, ammonium nitrate, sodium nitrite, potassium nitrite, silver nitrite, complex salt nitrites, solid organic nitrates, solid organic nitrites, solid organic amines, and mixtures and comelts thereof.

Preferred oxidizers include silver nitrate and mixtures and comelts comprising at least one of silver nitrate or ammonium nitrate and at least one of an alkali metal or an alkaline earth metal nitrate, ammonium nitrate, a complex salt nitrate, such as $Ce(NH_4)_2(NO_3)_6$ or $ZrO(NO_3)_2$, a dried, hydrated nitrate, such as $Ca(NO_3)_2.4H_2O$ or $Cu(NO_3)_2.2.5H_2O$, an alkali or alkaline earth metal chlorate or perchlorate, ammonium perchlorate, a nitrite of sodium, potassium, or silver, a solid organic nitrate, nitrite, or amine, such as guanidine nitrate, nitroguanidine and 5-aminotetrazole, respectively.

Powdered metal fuels useful in the invention include, but are not limited to, molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, and silicon, where molybdenum is the most preferred.

Examples of useful non-detonating autoignition materials and their ignition temperatures are provided in TABLE 8 for illustration purposes only. Similarly, a series of nitrate based non-detonating autoignition materials is provided in TABLE 9 for illustration purposes only.

TABLE 8

REPRESENTATIVE NON-DETONATING AUTOIGNITION COMPOSITIONS

| Formula (%, wt/wt) | Autoignition Temperature (° C.) |
|---|---|
| Strike anywhere match mix<br>11.0 animal glue + 4.0 starch + 32.0 potassium chlorate + 6.0 zinc oxide + 10.0 phosphorus sesquisulfide ($P_4S_3$) + 33.0 powdered glass + 4.0 rosin | 120–150 |
| Safety match mix<br>11.0 animal glue + 5.0 sulfur + 51.0 potassium chlorate + 7.0 zinc oxide + 4.0 manganese dioxide + 15.0 powdered glass + 1.0 potassium dichromate + 6.0 black iron oxide ($Fe_3O_4$ ) | 180–200 |
| Smoke mix<br>43.5 hexachloroethane + 46.5 zinc oxide + 10.0 aluminum | 167 |
| Friction primer mix<br>42.0 potassium chlorate + 42.0 antimony sulfide + 3.0 sulfur + 2.0 calcium carbonate + 3.0 meal powder + 3.0 ground glass + 5.0 gum Arabic | 139 |
| Friction primer mix<br>53.0 potassium chlorate + 22.0 antimony sulfide + 9.0 sulfur + 1.0 calcium carbonate + 10.0 ground glass + 5.0 gum arabic | 137 |
| Friction primer mix<br>63.0 potassium chlorate + 32.0 antimony sulfide + 5.0 gum arabic | 152 |
| Plastic bonded starter mix<br>39.0 potassium chlorate + 9.0 sodium bicarbonate + 3.0 acra-wax-filler + 5.0 synthesizer-plasticizer glass 22.0 NG + 845 Polymerecaptin crosslinker + 22.0 XD 2679 Resin | 150 |
| White smoke mix<br>44.0 hexachlorethane + 47.0 zinc oxide + 9.0 aluminum powder | 167 |
| Sugar based non-detonating autoignition material<br>73.6 potassium chlorate + 13.2 α-D Glucose + 13.2 sucrose | 140–160 |
| Match mix non-detonating autoignition material<br>50.0 potassium chlorate + 24.5 silica flour + 11.0 animal glue + 5.0 sulfur + 6.0 diatomaceous earth + 3.0 calcium carbonate + 0.5 potassium dichromate | 160 |
| Diazidodinitrophenol (DDNP) non-detonating autoignition material<br>100 diazidodinitrophenol | 180 |
| DDNP based non-detonating autoignition material<br>~100 diazidodinitrophenol + trace phenol | <180 |

TABLE 9

REPRESENTATIVE NITRATE BASED NON-DETONATING AUTOIGNITION COMPOSITIONS

| Formula (%, wt/wt) | Autoignition Temperature (° C.) |
|---|---|
| 23.5 potassium nitrate + 39.4 silver nitrate + 37.1 molybdenum | 131–135 |
| 24.75 guanidine nitrate + 34.65 silver nitrate + 1.0 fumed silica + 39.6 molybdenum | 145 165 |
| 24.75 guanidine nitrate + 20.4 silver nitrate + 14.25 potassium nitrate + 1.0 fumed silica + 39.6 molybdenum | 123–126 |
| 13.5 guanidine nitrate + 16.5 lithium nitrate + 28.0 ammonium perchlorate + 2.0 fumed silica + 40.0 molybdenum | 165 170 |
| 62.0 ammonium nitrate + 28.0 guanidine nitrate + 10.0 molybdenum | 155 |
| 52.0 ammonium nitrate + 11.5 guanidine nitrate + 11.5 nitroguanidine + 25.0 molybdenum | 155 |
| 66.5 ammonium nitrate + 8.5 Tetramethylammonium nitrate + 25.0 molybdenum | 120–130 |
| 69.6 ammonium nitrate + 17.0 guanidine nitrate + 3.4 Tetramethylammonium nitrate + 10.0 molybdenum | 120–130 |
| 20.8 ammonium nitrate + 20.8 5-aminotetrazole + 43.4 potassium chlorate + 15.0 molybdenum | 110–120 |
| 23.0 ammonium nitrate + 23.0 5-aminotetrazole + 39.0 potassium perchlorate + 15.0 molybdenum | 160–170 |
| 31.3 ammonium nitrate + 15.6 barbituric acid + 38.1 potassium chlorate + 15.0 molybdenum | 80–90 |
| 34.1 ammonium nitrate + 17.1 barbituric acid + 33.8 potassium perchlorate + 15.0 molybdenum | 170–180 |

Any of a variety of materials can be used for the heat transfer control medium, provided that they are not combustible, and transfer heat at a known rate. Useful materials include pure metals, alloys, ceramics, aluminas, silicas, alumina silicates, alumina borates, alumina silica borates, alumina nitrides, beryllias, carbides, composites, fiberglass, and graphite, with 316 Stainless Steel, which contains 18 percent chromium, 11 percent nickel, 2.5 percent molybdenum, no more than 0.1 percent carbon, with the balance iron, and Hastalloy Alloy C, which contains 16 percent molybdenum, 16 percent chromium, 5 percent iron, 4 percent tungsten, with a balance of manganese and silicon, being most preferred. It is also important to note that the materials used as the heat transfer control medium of the heat transfer initiator of the invention are not necessarily the same as those used to hold the pyrotechnic heat source or the autoignition material. For example, the side walls of the pyrotechnic chamber may be stainless steel, the heat transfer control medium might consist of graphite or copper while the autoignition material chamber is constructed of fiberglass. Moreover, The materials suitable for the heat transfer control medium are essentially limitless. Metal alloys can be varied to achieve desired thermal properties depending upon the desired application. An extensive listing of possible materials can be found in Table 23-5 (Properties of Metals and Alloys) of Perry and Chilton's *Chemical Engineers' Handbook*, Fifth Edition, pp. 23-8 through 23-53, McGraw Hill, 1973, the teachings of which are incorporated herein to the extent necessary to supplement this disclosure. Similarly, depending upon the application, the thermal properties of ceramics and composites can tailored by one skilled in the art to obtain the desired delay time and thermal output.

Preferably, heat loss is controlled by surrounding the heat transfer control medium and, in particular, the thermal choke, with an insulating material. The insulating material, 9, is preferably one that will absorb a minimum amount of heat, and, thus, prevent a loss of heat to the surroundings, resulting in substantially all of the heat from the combustion or reaction of the pyrotechnic heat source being transferred through the thermal choke to the autoignition material. Preferably, the insulating material is any of ceramics, filled epoxy resins, glasses, composite, including paints and laminates, non-heat-conductive polymers, expanded polytetrafluoroethylene (PFTE), e.g., GORE-TEXE® and TEFLON®, natural and synthetic rubbers, urethanes, and heat resistant composites such as those used as liners for propellants. Particularly useful insulating materials include glass tape, polyethylene, epoxies, expanded TEFLON®, and PTFE.

The delay time of the heat transfer initiator, defined as total time from the ignition of the pyrotechnic heat source to the ignition of the autoignition material, is a function of the chemical, physical, and ballistic properties of the components of the heat transfer initiator. These include, the heat generated by the combustion or reaction of the pyrotechnic heat source, the nature of the heat transfer control medium, including its thermal conductivity and heat loss to the surroundings, and the autoignition temperature of the autoignition material.

The delay time may be adjusted and determined by varying any of the components of the heat transfer initiator. For example, varying the type and amount of the pyrotechnic heat source, within the constraints determined by the heat transfer control medium and autoignition of the autoignition material, determines the amount of heat transferred to the heat transfer control medium, where the rate of heat transfer between the two materials is determined by the temperature difference between the two materials.

The nature of the heat transfer mechanism may also be altered to control the rate of heat transfer to the autoignition material and, thus, to determine the time delay. Properties of the heat transfer mechanism that can be varied include the material used to form the heat transfer control medium, e.g., pure metal, alloy, ceramic, etc., and the configuration of the heat transfer control medium, including its length, mass, shape of the connection between the pyrotechnic heat source and the autoignition material, and the amount and nature of any insulating material employed.

The autoignition temperature of the autoignition material is also a factor in determining the delay. Clearly, the lower the autoignition temperature of the autoignition material, the shorter the delay time will be, as the autoignition temperature of the autoignition material is simply dependent upon reaching a temperature of at least the autoignition temperature of the autoignition material.

The various significant adjustable parameters of the heat transfer initiator and the effects on the initiator time relative to those adjustments are provided in TABLE 10.

TABLE 10

VARIABLE EFFECTS ON IGNITION TIME

| COMPONENT | PROPERTY | EFFECT ON DELAY TIME WHEN PROPERTY DECREASED | EFFECT ON DELAY TIME WHEN PROPERTY INCREASED |
|---|---|---|---|
| Pyrotechnic Heat Source | | | |
| Material | Heat of Reaction | Increased | Decreased |
| Material | Density | Increased | Decreased |
| Autoignition Material | Autoignition Temperature | Decreased | Increased |
| Heat transfer control medium | | | |
| Material | Specific Heat | Decreased | Increased |
| Material | Thermal Conductivity | Increased | Decreased |
| Configuration | Cross Sectional Area | Increased | Decreased |
| Configuration | Distance between pyrotechnic and AIM | Decreased | Increased |
| Configuration | Total Mass | Variable | Variable |
| Insulation Material | Thermal Conductivity | Increased slightly | Decreased slightly |

The effects listed in Table 10 may be generalized as follows: the delay time is decreased when: (1) the amount of heat released by the combustion or reaction of the pyrotechnic heat source is increased, such as by using a pyrotechnic heat source having a higher heat of reaction and/or by increasing the amount of the pyrotechnic heat source; (2) the autoignition material is replaced with an autoignition material having a lower autoignition temperature; (3) the efficiency of the transfer of heat through the heat transfer control medium to the autoignition material is improved, such as by increasing the cross sectional area of the heat transfer control medium, shortening the length of the heat transfer control medium, i.e. the distance the heat must travel to ignite the autoignition material, and/or by using a material having a higher thermal conductivity for the heat transfer control medium.

Conversely, the delay time is increased when: (1) the amount of heat generated by the pyrotechnic is decreased, such as by using a pyrotechnic heat source having a lower heat of reaction and/or by decreasing the amount of the pyrotechnic heat source; (2) the autoignition material is replaced with an autoignition material having a higher autoignition temperature; (3) the transfer of heat through the heat transfer control medium to the autoignition material is decreased, such as by decreasing the cross sectional area of the heat transfer control medium, increasing the length of the heat transfer control medium, and/or by using a material having a lower thermal conductivity for the heat transfer control medium.

Changes in variables that affect the removal of heat generated by the pyrotechnic from the heat transfer initiator, such as the specific heat of the heat transfer control medium material or of the insulation material, will also influence the delay time. In certain applications, heat losses may be high, such as where the heat transfer initiator is used as a through-bulkhead initiator, and the bulkhead acts as a heat sink. In such applications, less of the heat generated by the combustion or reaction of the pyrotechnic heat source travels through the heat transfer control medium to the autoignition material, and as a result, the amount of time required for the autoignition material to be heated to its autoignition temperature is increased. In contrast, where heat losses are reduced, the delay time is also reduced. It is important to note that as the delay time is increased, heat losses to the surroundings become more critical, and insulating techniques become important.

The heat transfer initiator of the invention is most useful when the size of the initiator is critical due to space limitations, which accentuates the critical aspects of the performance of the chemical components. The use of a high heat output pyrotechnic and a low temperature autoignition material provide a broad range of heat transfer options and delay times, as demonstrated by the following non-limiting examples.

EXAMPLES

The following non-limiting examples are merely illustrative of the preferred embodiments of the present invention, and are not to be construed as limiting the invention, the scope of which is defined by the appended claims.

A prototype heat transfer initiator similar to that depicted in FIG. 1 was made from a 1 inch long stainless steel cylinder, having a 0.375 inch outer diameter (OD) by drilling a 0.25 inch diameter cavity at each end of the cylinder. The cavity for the pyrotechnic heat source was approximately 0.5 inch deep, and the cavity for the autoignition material was approximately 0.125 inch deep. Thus, the pyrotechnic heat source and the autoignition material were separated by approximately 0.125 inch of stainless steel.

The heat transfer initiator was prepared by placing 0.1553 grams of an autoignition material, comprising potassium nitrate, silver nitrate, and molybdenum powder,. i.e., 23.5% $KNO_3$, 39.4% $AgNO_3$, and 37.1% Mo, and having an autoignition temperature of 131° C., into the autoignition material cavity. Similarly, 0.6119 grams of a powder containing 60 weight percent magnesium (Mg), 35 weight percent TEFLON®, and 15 weight percent VITON® was placed into the pyrotechnic heat source cavity. Each end of the heat transfer initiator was sealed with adhesive-backed aluminized Mylar film. A small electric match was placed over the end of the assembly containing the pyrotechnic heat source, and the electric match was sealed into position with additional Mylar film.

The heat of reaction of the pyrotechnic material used for the heat source was 1124 cal/g, and, thus, the 0.6119 grams of pyrotechnic material was sufficient to generate 687.8 calories upon combustion. Assuming that all 687.8 calories generated by the pyrotechnic was transferred to the heat transfer initiator with no loss of heat to the surroundings, the temperature of the stainless steel heat transfer initiator would increase by 218.4° C., which would be more than sufficient to ignite the autoignition material when the heat transfer initiator was at ambient temperature. Therefore, a sufficient amount of heat was available to heat the autoignition material to at least its autoignition temperature.

The assembly was placed into the center of a 1.25 inch long CYCOLAC®, an acrylonitrile-butadiene-styrene (ABS) thermoplastic resin, tube having a 0.5 inch ID with a notch cut in the edge to allow placement of the electric match wires. The autoignition material containing end of the assembly was placed flush with the non-notched end of the CYCOLAC® tube and sealed into place with additional Mylar. An insulating material, i.e., 1.998 grams of Dow 93–104 Silicone RTV, prepared according to vendor directions, was injected into the space between the heat transfer initiator and the CYCOLAC® tube, but not over the top the autoignition material. An additional 0.5545 g of Dow 93–104 was placed over the match to completely seal the pyrotechnic end of the heat transfer initiator. The complete assembly or heat transfer initiator was placed in a 75° C. oven for 30 minutes to initiate the curing of the Dow 93–104, and then stored at ambient temperature for approximately 66 hours.

The heat transfer initiator was mounted in a clamp on a ring stand behind a plexiglass shield at an ambient temperature of 21° C. The wires of the electric match were attached to a DC power source, igniting the electric match, which, in turn, ignited the pyrotechnic heat source. A stopwatch was started with the ignition of the electric match. The pyrotechnic, ignited by the electric match, burned for approximately 2 seconds, and the autoignition material ignited 14.4 seconds after the ignition of the electric match.

The heat transfer was very efficient, as indicated by the ignition of the autoignition material, which was rapidly heated to its autoignition temperature, and clearly demonstrates that a delayed ignition of an autoignition material can be provided by the transfer of heat generated by the combustion of a pyrotechnic heat source through a heat flow controlling barrier or thermal choke. As discussed above, the delay time of 14.4 seconds can be adjusted by increasing or decreasing the rate of heat flow from the pyrotechnic heat source to the autoignition material, such as by changing the diameter of the connection formed by the thermal choke between the pyrotechnic heat source and the autoignition material, thereby changing the time required for heat to transfer and raise the temperature of the autoignition material to its ignition threshold. The results of similar experiments in which the various parameters, as are discussed above, are given in TABLE 11 and TABLE 12. The compositions of the pyrotechnic heat sources, autoignition materials, ignition boosters, and inhibitor used in the examples are as follows, where VAAR is vinyl alcohol acetate resin, and Cab-O-Sil M5 is fumed silica:

Formula 1 45.0% W, 40.5% $BaCrO_4$, 14.5% $KClO_4$, 1.0% VAAR

Formula 2 23.5% $KNO_3$, 39.4% $AgNO_3$, 37.1% Mo

Formula 3 24.75% $CH_6N_4O_3$, 34.65% $AgNO_3$, 1.0% Cab-O-Sil M5, 39.6% Mo

Formula 4 20.4% $AgNO_3$, 14.25% $KNO_3$, 24.75% $CH_6N_4O_3$, 1.0% Cab-O-Sil M5, 39.6% Mo Formula 5 91.5% R45M, 84.7% IPDI, 0.1% TPB, 1.0% DOZ+Dibutyl Tin Dilaurate Formula 6 65% Zr, 25% $Fe_2O_3$, 10% Diatomaceous Earth, 1% VAAR Formula 7 16.5% $LiNO_3$, 13.5% $CH_6N_4O_3$, 28.0% $NH_4ClO_4$, 2.0% Cab-O-Sil M5, 40.0% Mo Formula 8 81.6% Ti, 18.4% B Formula 9 24% Zr, 34% Si, 16% $Fe_2O_3$, 24% $KClO_4$, 2% $Na_2SiO_3$ Formula 10 46.67% Ti, 23.33% amorphous B, 30.0% $BaCrO_4$ Formula 11 44.2% Ti, 13.3% B, 42.5% $KClO_4$

TABLE 11

HEAT TRANSFER INITIATOR SYSTEM EXAMPLES

| System Number | 1 | 2 | 3 | 4 | 5 | 6 | 7 | 8 | 9 | 10 |
|---|---|---|---|---|---|---|---|---|---|---|
| HTI Material: | 316 Stainless Steel | 316 Stainless Steel | 316 Stainless Steel | 316 Stainless Steel | 316 Stainless Steel | 316 Stainless Steel | Hastalloy Alloy C | Hastalloy Alloy C | Hastalloy Alloy C | 316 Stainless Steel |
| HTI Dimensions: | 1.00" × 0.250" | 1.00" × 0.250" | 1.00" × 0.250" | 1.00" × 0.250" | 1.00" × 0.250" | 1.00" × 0.250" | 1.00" × 0.250" | 1.00"× 0.250" | 1.00" × 0.250" | 1.00" × 0.188" |
| Pyro Cavity: | 0.625" × 0.0625" | 0.625" × 0.0625" | 0.625" × 0.0625" | 0.500" × 0.0625" | 0.500" × 0.0625" | 0.625" × 0.0625" | 0.500" × 0.188" | 0.500" × 0.188" | 0.500" × 0.188" | 0.500" × 0.156" |
| AIM Cavity: | 0.125" × 0.0625" | 0.125" × 0.0625" | 0.125" × 0.0625" | 0.125" × 0.0625" | 0.125" × 0.0625" | 0.125" × 0.0625" | 0.200" × 0.188" | 0.200" × 0.188" | 0.200" × 0.188" | 0.200" × 0.156" |
| Heat transfer control medium: | 0.250" × 0.125" | 0.125" × 0.125" | 0.125" × 0.0625" | 0.375" × 0.250" | 0.250" × 0.125" | 0.250" × 0.250" | 0.250" × 0.250" | 0.250" × 0.250" | 0.250" × 0.250" | 0.250" × 0.188" |
| Insulation: | Glass Tape | Glass Tape | Glass Tape | Glass Tape | Glass Tape | Glass Tape | Poly-ethylene Tubing | Epoxy | Inhibitor (Form. 5) | Expanded Teflon ® |
| Heat | (Form. 1) | (Form. 1) | (Form. 1) | (Form. 1) | (Form. 1) | (Form. 1) | (Form. 1) | (Form. 1) | (Form. 1) | (Form. 1) |

TABLE 11-continued

HEAT TRANSFER INITIATOR SYSTEM EXAMPLES

| System Number | 1 | 2 | 3 | 4 | 5 | 6 | 7 | 8 | 9 | 10 |
|---|---|---|---|---|---|---|---|---|---|---|
| Source: Ignition Booster: | None | None | None | None | None | None | None | None | None | (Form. 6) |
| AIM | (Form. 2) | (Form. 2) | (Form. 2) | (Form. 2) | (Form. 2) | Form. 3) | (Form. 4) | (Form. 4) | (Form. 4) | (Form. 4) |
| Test Temperature | 75° F. | 75° F. | 75° F. | 75° F. | 75° F. | 75° F. | 75° F. | 75° F. | 75° F. | 75° F. |
| Time to Auto-ignition: | 30 sec. | 39 sec. | 57 sec. | 64 sec. | 54 sec. | 58 sec. | 81 sec. | 27 sec. | 38 sec. | 19 sec. |

TABLE 12

HEAT TRANSFER INITIATOR SYSTEM EXAMPLES

| System Number | 11 | 12 | 13 | 14 | 15 | 16 | 17 | 18 | 19 |
|---|---|---|---|---|---|---|---|---|---|
| HTI Material: | 316 Stainless Steel | 316 Stainless Steel | 316 Stainless Steel | 316 Stainless Steel | 316 Stainless Steel | 316 Stainless Steel | 316 Stainless Steel | 316 Stainless Steel | 316 Stainless Steel |
| HTI Dimensions: | 1.00" × 0.188" | 1.00" × 0.188" | 1.00" × 0.188" | 1.00" × 0.188" | 1.00" × 0.188" | 1.00" × 0.188" | 1.00" × 0.188" | 1.00" × 0.188" | 1.00" × 0.188" |
| Pyro Cavity: | 0.500" × 0.156" | 0.500" × 0.156" | 0.500" × 0.156" | 0.500" × 0.156" | 0.500" × 0.159" | 0.500" × 0.159" | 0.500" × 0.159" | 0.500" × 0.159" | 0.500" × 0.159" |
| AIM Cavity: | 0.200" × 0.156" | 0.200" × 0.156" | 0.200" × 0.156" | 0.200" × 0.156" | 0.250" × 0.159" | 0.250" × 0.159" | 0.250" × 0.159" | 0.250" × 0.159" | 0.250" × 0.159" |
| Heat transfer control medium: | 0.250" × 0.188" | 0.250" × 0.188" | 0.250" × 0.188" | 0.250" × 0.188" | 0.200" × 0.188" | 0.200" × 0.188" | 0.250" × 0.188" | 0.200" × 0.188" | 0.200" × 0.188" |
| Insulation: | Expanded Teflon ® | PTFE Tubing | PTFE Tubing | Expanded Teflon ® | Expanded Teflon ® | Expanded Teflon ® | Expanded Teflon ® | Expanded Teflon ® | Expanded Teflon ® |
| Heat Source: | (Form. 1) | (Form. 1) | (Form. 1) | (Form. 8) | (Form. 10) | (Form. 10) | (Form. 10) | (Form. 11) | (Form. 11) |
| Ignition Booster: | (Form. 6) | (Form. 6) | (Form. 6) | (Form. 9) | (Form. 1) | (Form. 1) | (Form. 1) | (Form. 9) | (Form. 9) |
| AIM | (Form. 7) | (Form. 4) | (Form. 7) | (Form. 4) | (Form. 4) | (Form. 4) | (Form. 4) | (Form. 4) | (Form. 7) |
| Test Temperature | 75° F. | 75° F. | 75° F. | 75° F. | 75° F. | −40° F. | 160° F. | 75° F. | 75° F. |
| Time to Auto-ignition: | 36 sec. | 25 sec. | 36 sec. | 22 sec. | 74 sec. | 100 sec. | 83 sec. | 15 sec. | 25 sec. |

While it is apparent that the invention disclosed herein is well calculated to fulfill the objects stated above, it will be appreciated that numerous modifications and embodiments may be devised by those skilled in the art. Therefore, it is intended that the appended claims cover all such modifications and embodiments that fall within the true spirit and scope of the present invention.

We claim:

1. A non-detonating heat transfer initiator, comprising:

a heat transfer control medium, having a heat input portion and a heat output portion, and a non-detonating autoignition material, having an autoignition temperature, in thermal contact with the heat output portion; wherein application of heat to the heat input portion causes a transfer of heat through the heat transfer control medium to the heat output portion, heating the heat output portion, such that, upon application of a sufficient amount of heat to the heat input portion, the heat output portion is heated to the autoignition temperature of the non-detonating autoignition material, igniting the non-detonating autoignition material, thus producing a non-detonating thermal output.

2. The non-detonating heat transfer initiator of claim 1, further comprising a pyrotechnic heat source in thermal contact with the heat input portion.

3. The non-detonating heat transfer initiator of claim 2, wherein the pyrotechnic heat source is selected from the group consisting of thermites, thermates, delay compositions, halogenated compositions, torch/flare compositions, igniter compositions, intermetallic compositions, and mixtures thereof.

4. The non-detonating heat transfer initiator of claim 1, wherein the heat transfer control medium is a bulkhead, having first and second opposed side surfaces, wherein the first side surface serves as the heat input portion, and the second side surface serves as the heat output portion.

5. The non-detonating heat transfer initiator of claim 4, wherein the heat output portion comprises a heat output source cavity defined in the second opposed side of the bulkhead.

6. The non-detonating heat transfer initiator of claim 4, further comprising a pyrotechnic heat source in thermal contact with the heat input portion.

7. The non-detonating heat transfer initiator of claim 6, wherein the heat input portion comprises an input heat source cavity defined in the first side surface of the bulkhead.

8. The non-detonating heat transfer initiator of claim 1, wherein the heat transfer control medium is in the form of a rod or disk, having first and second opposed surfaces, wherein the first surface serves as the heat input portion, and the second surface serves as the heat output portion.

9. The non-detonating heat transfer initiator of claim 8, wherein the heat output portion comprises an output heat source cavity defined in the second opposed surface of the rod or disk.

10. The non-detonating heat transfer initiator of claim 8, further comprising a pyrotechnic heat source in thermal contact with the heat input portion.

11. The non-detonating heat transfer initiator of claim 10, wherein the heat input portion comprises an input heat source cavity defined in the first surface of the rod or disk.

12. The non-detonating heat transfer initiator of claim 8, wherein the heat transfer control medium serves as a thermal choke having a cross sectional area and a thermal conductivity that control the transfer of heat from the heat input portion to the heat output portion.

13. The non-detonating heat transfer initiator of claim 8, further comprising an insulating material at least partially surrounding the heat transfer control medium to at least partially reduce heat loss from the heat transfer control medium.

14. The non-detonating heat transfer initiator of claim 13, wherein the insulating material is selected from the group consisting of ceramics, filled epoxy resins, glasses, composites, paints, laminates, non-heat-conductive polymers, expanded polytetrafluoroethylene, natural and synthetic rubbers, urethanes, and heat resistant composites.

15. The non-detonating heat transfer initiator of claim 13, wherein the insulating material is glass tape, polyethylene, an epoxy, or expanded polytetrafluoroethylene.

16. The non-detonating heat transfer initiator of claim 8, wherein the heat transfer control medium is positioned in an aperture defined by a bulkhead, the bulkhead having a first side and a second opposed side.

17. The non-detonating heat transfer initiator of claim 16, further comprising an insulating material at least partially surrounding the heat transfer control medium to at least partially reduce heat loss from the heat transfer control medium.

18. The non-detonating heat transfer initiator of claim 17, wherein the insulating material is selected from the group consisting of ceramics, filled epoxy resins, glasses, composites, paints, laminates, non-heat-conductive polymers, expanded polytetrafluoroethylene, natural and synthetic rubbers, urethanes, and heat resistant composites.

19. The non-detonating heat transfer initiator of claim 17, wherein the insulating material is glass tape, polyethylene, an epoxy, or expanded polytetrafluoroethylene.

20. The non-detonating heat transfer initiator of claim 17, wherein the insulating material forms at least a partial thermal barrier between the heat transfer control medium and the bulkhead.

21. The non-detonating heat transfer initiator of claim 16, wherein at least one of the heat input portion and the heat output portion is substantially flush with the first side or the second opposed side of the bulkhead.

22. The non-detonating heat transfer initiator of claim 16, wherein at least one of the heat input portion and the heat output portion extends outwardly from the first side or the second opposed side of the bulkhead.

23. The non-detonating heat transfer initiator of claim 1, wherein the non-detonating autoignition material is selected from the group consisting of nitrocellulose, nitroglycerine based smokeless gun powders, safety and strike anywhere match compositions, smoke compositions, friction primer compositions, plastic bonded starter compositions, white smoke compositions, sugar based compositions, diazidodinitrophenol (DDNP) compositions, mixtures of an oxidizer composition and a powdered metal fuel, and mixtures thereof.

24. The non-detonating heat transfer initiator of claim 1, wherein the non-detonating autoignition material comprises a mixture of an oxidizer composition and a powdered metal fuel, and wherein the oxidizer composition is selected from the group consisting of alkali metal nitrates, alkaline earth metal nitrates, complex salt nitrates, dried, hydrated nitrates, silver nitrate, alkali metal chlorates, alkali metal perchlorates, alkaline earth metal chlorates, alkaline earth metal perchlorates, ammonium perchlorate, ammonium nitrate, sodium nitrite, potassium nitrite, silver nitrite, complex salt nitrites, solid organic nitrates, solid organic nitrites, solid organic amines, and mixtures and comelts thereof.

25. The non-detonating heat transfer initiator of claim 24, wherein the oxidizer composition is selected from the group consisting of silver nitrate, and mixtures and comelts of at least one of silver nitrate and ammonium nitrate and at least one of alkali metal nitrates, alkaline earth metal nitrates, ammonium nitrate, complex salt nitrates, dried, hydrated nitrates, alkali metal chlorates, alkali metal perchlorates, alkaline earth metal chlorates, alkaline earth metal perchlorates, ammonium perchlorate, sodium nitrite, potassium nitrite, silver nitrite, solid organic nitrates, solid organic nitrites, and solid organic amines.

26. The non-detonating heat transfer initiator of claim 24, wherein the powdered metal fuel is selected from the group consisting of molybdenum, magnesium, calcium, strontium, barium, titanium, zirconium, vanadium, niobium, tantalum, chromium, tungsten, manganese, iron, cobalt, nickel, copper, zinc, cadmium, tin, antimony, bismuth, aluminum, cerium, silicon, and mixtures thereof.

27. The non-detonating heat transfer initiator of claim 1, wherein the non-detonating autoignition material is selected from the group consisting of mixtures of potassium nitrate, silver nitrate, and molybdenum; mixtures of guanidine nitrate, silver nitrate, fumed silica, and molybdenum; mixtures of silver nitrate, potassium nitrate, guanidine nitrate, fumed silica, and molybdenum; mixtures of lithium nitrate, guanidine nitrate, ammonium perchlorate, fumed silica, and molybdenum; mixtures of ammonium nitrate, guanidine nitrate, and molybdenum; mixtures of ammonium nitrate, guanidine nitrate, nitroguanidine, and molybdenum; mixtures of ammonium nitrate, tetramethylammonium nitrate, and molybdenum; mixtures of ammonium nitrate, guanidine nitrate, tetramethylammonium nitrate, and molybdenum; mixtures of ammonium nitrate, 5-aminotetrazole, potassium chlorate, and molybdenum; mixtures of ammonium nitrate, 5-aminotetrazole, potassium perchlorate, and molybdenum; mixtures of ammonium nitrate, barbituric acid, potassium chlorate, and molybdenum; and mixtures of ammonium nitrate, barbituric acid, potassium perchlorate, and molybdenum.

28. The non-detonating heat transfer initiator of claim 1, wherein a least a portion of the heat transfer control medium is formed from at least one material selected from the group consisting of metals, alloys, ceramics, aluminas, silicas, alumina silicates, alumina borates, alumina silica borates, alumina nitrides, beryllias, carbides, composites, fiberglass, and graphite.

29. The non-detonating heat transfer initiator of claim 1, further comprising an insulating material at least partially surrounding the heat transfer control medium to at least partially reduce heat loss from the heat transfer control medium.

30. The non-detonating heat transfer initiator of claim 29, wherein the insulating material is selected from the group consisting of ceramics, filled epoxy resins, glasses, composites, paints, laminates, non-heat-conductive polymers, expanded polytetrafluoroethylene, natural and synthetic rubbers, urethanes, and heat resistant composites.

31. The non-detonating heat transfer initiator of claim 29, wherein the insulating material is glass tape, polyethylene, an epoxy, expanded polytetrafluoroethylene.

32. The non-detonating heat transfer initiator of claim 1, wherein the heat transfer control medium conducts heat at a rate such that a delay time of from at least about 1 second to about 90 seconds elapses between application of heat to the heat input portion and ignition of the non-detonating autoignition material.

33. The non-detonating heat transfer initiator of claim 1, wherein the heat transfer control medium conducts heat at a rate such that a delay time of greater than about 90 seconds elapses between application of heat to the heat input portion and ignition of the non-detonating autoignition material.

34. A method of producing a non-detonating thermal output, the method comprising:

applying heat to a heat transfer control medium in thermal contact with a non-detonating autoignition material, the non-detonating autoignition material having an autoignition temperature;

conducting at least a portion of this heat through the heat transfer control medium to the non-detonating autoignition material;

raising the temperature of the non-detonating autoignition material with the heat to at least the autoignition temperature, and, thus, igniting the non-detonating autoignition material; and producing a non-detonating thermal output due to the ignition.

35. The method of claim 34, further comprising insulating at least a portion of the heat transfer control medium to prevent heat loss.

36. The method of claim 34, further comprising placing a pyrotechnic heat source in thermal contact with the heat transfer control medium;

igniting the pyrotechnic heat source, thereby producing heat from combustion or reaction of the pyrotechnic heat source; and transferring at least a portion of the heat from the combustion or reaction to the heat transfer control medium.

* * * * *

UNITED STATES PATENT AND TRADEMARK OFFICE

CERTIFICATE OF CORRECTION

PATENT NO. : 6,539,869 B2
DATED : April 1, 2003
INVENTOR(S) : Gregory D. Knowlton et al.

It is certified that error appears in the above-identified patent and that said Letters Patent is hereby corrected as shown below:

Column 3,
Line 67, “a initiator” should read -- an initiator --.

Column 5,
Line 29, “As It will be recognized that” should be deleted.

Column 11,
Line 46, “initiator” should read -- Initiator; and
Line 65, “a initiator 70,” should read -- an initiator 70, --.

Column 18,
Line 32, “nitrate” should read -- nitrates, --.

Column 20,
Line 35, “Moreover, The” should read -- Moreover, the --; and
Line 58, “GORE-TEXE®” should read -- GORE-TEX® --.

Column 23,
Line 32, “top the” should read -- top of the --.

Column 28,
Line 62, “a least” should read -- at least --.

Signed and Sealed this

Twenty-eighth Day of October, 2003

JAMES E. ROGAN
*Director of the United States Patent and Trademark Office*